US010181677B2

(12) United States Patent
Vassgård

(10) Patent No.: US 10,181,677 B2
(45) Date of Patent: Jan. 15, 2019

(54) SUBSEA HIGH VOLTAGE CONNECTION ASSEMBLY

(71) Applicant: Benestad Solutions AS, Lierskogen (NO)

(72) Inventor: Johannes Arngrim Vassgård, Rasta (NO)

(73) Assignee: Benestad Solutions AS, Lierskogen (NO)

( * ) Notice: Subject to any disclaimer, the term of this patent is extended or adjusted under 35 U.S.C. 154(b) by 0 days.

(21) Appl. No.: 15/316,705

(22) PCT Filed: Jun. 25, 2015

(86) PCT No.: PCT/NO2015/050116
§ 371 (c)(1),
(2) Date: Dec. 6, 2016

(87) PCT Pub. No.: WO2015/199550
PCT Pub. Date: Dec. 30, 2015

(65) Prior Publication Data

US 2017/0187143 A1 Jun. 29, 2017

(30) Foreign Application Priority Data

Jun. 25, 2014 (NO) ..... 20140811

(51) Int. Cl.
*H01R 13/523* (2006.01)
*E21B 33/038* (2006.01)
(Continued)

(52) U.S. Cl.
CPC ..... *H01R 13/523* (2013.01); *E21B 33/0385* (2013.01); *H01R 13/2421* (2013.01);
(Continued)

(58) Field of Classification Search
CPC ..... H01R 13/523
See application file for complete search history.

(56) References Cited

U.S. PATENT DOCUMENTS 3,508,188 A 4/1970 Buck
4,050,765 A * 9/1977 Duesterhoeft ..... H01R 13/523 439/204

(Continued)

FOREIGN PATENT DOCUMENTS

FR 2529396 A1 12/1983
GB 2486900 A 7/2012
WO WO-2008039887 A2 4/2008

OTHER PUBLICATIONS

Erlandsson, Tomas, "International Search Report," prepared for PCT/NO2015/050116, dated Dec. 23, 2015, six pages.

(Continued)

*Primary Examiner* — James Harvey
(74) *Attorney, Agent, or Firm* — Winstead PC

(57) ABSTRACT

Subsea high voltage connection assembly (10) comprising a first section (100) having a first section body (104) to which a set of first connector(s) (111) is arranged and a second section (200) having second section body (204) to which a set of second connector(s) (211) is arranged. The assembly (10) further has a section body movement arrangement (103, 400, 9, 123) adapted to move one of the section bodies (104, 204) towards and away from the other section body, between a disengaged position and an engaged position. Further, the assembly (10) has a connector movement arrangement (105, 400). Also disclosed are a method and a subsea high voltage wet mate connector assembly.

26 Claims, 24 Drawing Sheets

(51) Int. Cl.

| | |
|---|---|
| ***H01R 13/24*** | (2006.01) |
| ***H01R 13/631*** | (2006.01) |
| ***H01R 13/629*** | (2006.01) |
| *E21B 41/00* | (2006.01) |

(52) U.S. Cl.
CPC ..... *H01R 13/629* (2013.01); *H01R 13/6315* (2013.01); *E21B 41/0007* (2013.01)

(56) References Cited

U.S. PATENT DOCUMENTS 4,080,025 A * 3/1978 Garnier ..... E21B 33/038 166/343
4,364,433 A * 12/1982 Fisher ..... E21B 33/0355 166/339
4,489,959 A * 12/1984 Satterwhite ..... E21B 33/038 285/18
6,017,065 A * 1/2000 Hellesøe ..... E21B 33/038 285/124.2
8,336,922 B2 * 12/2012 Tiberghien ..... F16L 37/56 137/594
2007/0161272 A1 * 7/2007 Lagathu ..... H01R 13/6315 439/138
2009/0042437 A1 * 2/2009 Mæland ..... H01R 13/523 439/519
2009/0080836 A1 * 3/2009 Cairns ..... G02B 6/3816 385/56
2009/0288836 A1 * 11/2009 Goodall ..... F16L 1/26 166/336
2014/0112699 A1 4/2014 Lewkoski
2017/0187143 A1 * 6/2017 Vassgard ..... H01R 13/523
2017/0242197 A1 * 8/2017 Tucker ..... G02B 6/387
2017/0346215 A1 * 11/2017 Puskar ..... H01R 13/5202

OTHER PUBLICATIONS

Legeay, Josselin, "Subsea Processing: Boosting and Gas Compression Enabled Through HV Wet Mate Connectors and Penetrators," Marine Technology Reporter, Apr. 2014, pp. 28-31.

* cited by examiner

SUBSEA HIGH VOLTAGE CONNECTION ASSEMBLY

The present invention relates to a subsea high voltage connection assembly which is suited to connect and disconnect high voltage connectors by remote operation on the seabed. The invention also relates to a method for connection of such connectors. Also disclosed is a novel high voltage wet mate connector.

BACKGROUND

Subsea connection assemblies are known, which typically comprises two facing stab plates or junction plates which each comprises a set of male connectors and female connectors that are brought together when the stab plates are moved towards each other. In order to provide mutual alignment between the two plates, it is common to arrange guide pins that extend out from one stab plate and which will enter a guide funnel in the opposite plate. An example of such a solution is disclosed in international patent application publication WO2008039887.

Patent application publication GB2486900 discloses a stab plate having a support that allows it to slide and thereby to become aligned along two perpendicular directions. In addition, the support comprises a pivot which allows the face of the stab plate to align its angle with respect to an opposite stab plate. One of the stab plates is provided with two guide pins which are adapted to be received in facing guide funnels of the opposite stab plate.

Patent publication U.S. Pat. No. 6,017,065 describes a connector assembly having a plurality of male and female connectors adapted to be used subsea. Typically, the connector can be operated with a remotely operated vehicle (ROV). Two facing stab plates are aligned and then moved towards each other to obtain connection between the male and female connectors. One stab plate comprises a guide post that enters a guide sleeve when the two stab plates approach each other.

By using at least two guide pins and facing guide funnels, one is able to align both the mutual position and mutual angle between two stab plates. To achieve this, however, the engagement path of the guide pins within the guide funnels needs to be sufficiently large. In some cases, having such a large engagement path is not desirable. An example of such a case may be a case where one wants to reduce the movement of the lines to which the connectors are connected.

THE INVENTION

According to a first aspect of the present invention, there is provided a subsea high voltage connection assembly comprising a first section with a first section body, to which a set of first connector(s) is arranged, and a second section having second section body to which a set of second connector(s) is arranged. The subsea connection assembly further comprises a section body movement arrangement which is adapted to move one of the section bodies towards and away from the other section body, between a disengaged position and an engaged position. According to the first aspect of the present invention, the subsea connection assembly further comprises a connector movement arrangement.

The section body movement arrangement will be adapted to move the first and second section body mutually towards or away from each other (preferably by moving only one of them though). It can comprise a combination of a stroke tool, a stroke tool interface and a guiding means for guiding movement of the section body in question towards or away from the opposite section body. As a person skilled in the art will appreciate, there are available, however, a plurality of solutions for moving the first and second section bodies towards or away from each other. The movement may for instance be provided with hydraulic actuators (typically hydraulic pistons). One can also imagine employing electric actuators. Advantageously, the section body movement arrangement and the connector movement arrangement are arranged in the same section (i.e. either the first section or the second section). One may, however, also arrange the section body movement in one of the two sections, while the connector movement arrangement is arranged in the other section. The connector movement arrangement can operate independently from the section body movement arrangement.

When the first and second section bodies are in their engaged position, they are moved towards each other and aligned with respect to each other. This alignment will also mutually align the first connectors and the second connectors. The disengaged position is, on the contrary, their position when the section bodies have not been moved towards each other. In this position they will typically be misaligned with respect to each other. Actually, in most embodiments they will be intentionally misaligned in the disengaged position, the reason for this will appear from the detailed description.

The connector movement arrangement is adapted to connect and disconnect facing high voltage wet mate connectors. Thus, in a connection procedure, the first and second section bodies will be moved mutually towards each other with a first movement, by using the section body movement arrangement. Then, with a second movement, the connector movement arrangement will provide a connection between the connectors, typically by providing mutual movement of a male and female connector.

A set of connectors may be one connector only, or a plurality of connectors. In some embodiments, there is a plurality of connectors in one section and they are all connected to the same connector movement arrangement, hence being moved simultaneously. In other embodiments, there assembly comprises at least two pluralities of connectors in one section, e.g. two groups of three high voltage connectors, wherein each group is adapted to be moved independently.

The first section and the second section may indeed be fixed to a common structure, however can also be fixed to two different, however adjacently arranged structures.

With the term high voltage is herein meant voltages of 1 kV and above.

In typical embodiments of the first aspect of the present invention, when in the engaged position, the set of first connector(s) and the set of second connector(s) are interchangeable between a disconnected mode and a connected mode.

Thus, the connector movement arrangement is connected to the set of first or the set of second connector(s), and is adapted to move the set between said disconnected mode and connected mode. Typically, when moving the connectors from a disconnected to a connected mode, male connectors will be inserted into female connectors by means of the connector movement arrangement.

Advantageously, the first section body can comprise a first alignment plate and the second section body can comprise an oppositely arranged second alignment plate. One of the alignment plates comprises a guide pin and the other comprises a facing guide funnel. The alignment plates being oppositely arranged means that they are facing each other.

In a preferred embodiment comprising the alignment plates introduced above, the guide pin and/or the guide funnel exhibits a tapered face. Moreover, the guide pin has a head portion at its front end and a stem portion between the head portion and its base, wherein the head portion exhibits a larger diameter than the stem portion. As will be appreciated from the detailed description below, such a solution provides the possibility of an angle between the guide funnel and the guide pin.

The head portion may at its outer diameter have a convex shape.

In another embodiment involving the combination of a guide funnel and guide pin, the guide funnel comprises a radially inwardly protruding collar, past which a cylindrical part of the guide pin is adapted to travel upon insertion in the guide funnel. This also will proved the angular freedom between the guide funnel and guide pin.

The first alignment plate can advantageously comprise two first abutment faces and the second alignment plate two second abutment faces. The first and second abutment faces are then adapted to abut against each other in a position of the alignment plates where the guide pin is fully inserted into the guide funnel.

Here, the term fully inserted shall mean that that the guide pin is inserted until it stops (i.e. not necessarily until the entire guide pin is inserted).

In some embodiments, the set of first connector(s) or the set of second connector(s) is fixed to a reaction plate. The reaction plate is functionally connected to said connector movement arrangement and is movably supported in the first or second section body.

Thus, the reaction plate is movable with respect to the section body in which it is supported. This means that the assembly has a section body which is movable, and also a reaction plate which is movable with respect to the section body. As understood by a person skilled in the art, the reaction plate may have another form than a plate form.

The set of first or set of second connector(s) can connect to lines that extend out from the connection assembly, via a set of penetrators and a cable support assembly. The lines can then be retained in the cable support assembly and the cable support assembly will be supported in the first or second section body with a sliding support arrangement.

The reaction plate can connect to the cable support assembly with a connection member that connects to the cable support assembly with a flexible connection.

Preferably, the flexible connection is able to transmit compressive or tensile forces between the reaction plate and the cable support assembly, but not bending forces. In this manner it is ensured that the connectors and the reaction plate are not loaded with forces crosswise to their longitudinal extension. In particular, the connectors will substantially only be loaded with forces from the reaction plate and possible counterforces from the opposite connectors with which they mate.

In some embodiments, the first or second section, whichever comprises the section body movement arrangement, has a section body guiding arrangement adapted to guide the first or second section body along a first movement path between the disengaged and engaged position. The first movement path has two movement path sections, wherein the movement path section being closest to or including the disengaged position exhibits less freedom of movement in transverse directions, than the movement path section being closest to or including the engaged position. Transverse directions means directions that are transverse to the first movement path.

Thus, at the start of the movement of the section body, such as the first section body, from the disengaged position towards the engaged position, the movement will be rather straight towards the oppositely arranged section body. However, after some distance along the movement path, the section body guiding arrangement provides for increased freedom of movement crosswise/transverse to the movement direction towards the engaged position. The purpose of this is to allow the moving section body to become aligned with the opposite section body when they approach each other. However, at the start of the movement path, it is still ensured that guiding means (e.g. guide funnel and guide pin) which will contribute in said alignment, will meet each other within their capture range. These features will be explained in more detail in the description of embodiment further below.

Advantageously, the section body guiding arrangement comprises a guide slot in a plate which is part of the section body and a guide member which is fixed. The guide member has a guide portion that extends through the guide slot and an end flange that limits travel in said transverse directions. A freedom limitation element is fixed to the plate having the guide slot and is positioned between the plate and end flange along the movement path section being closest to or including the disengaged position.

In this context, the guide member is fixed means that it is not moving. It may for instance be fixed to a large subsea module or other subsea structure.

As long as the freedom limitation element is arranged between the plate and the end flange, less movement is possible in the transverse directions. However, once the freedom limitation element has been moved out of this position, along with the movement of the section body, the freedom of movement in the transverse directions is increased. The freedom limitation element could preferably be shaped like a plate or a list.

According to a second aspect of the present invention there is provided a subsea high voltage connection assembly comprising a first section having a first section body to which a set of first connector(s) is arranged and a second section having a second section body to which a set of second connector(s) is arranged. The subsea connection assembly further comprises a section body movement arrangement adapted to move one of the section bodies towards and away from the other section body, between a disengaged position and an engaged position. The first section body has a first alignment plate and the second section body has an oppositely arranged second alignment plate. One of the alignment plates comprises a guide pin and the other comprises a facing guide funnel. According to the second aspect of the present invention, the first alignment plate comprises two first abutment faces and the second alignment plate comprises two second abutment faces. The first and second abutment faces are adapted to abut against each other in a position of the alignment plates where the guide pin is fully inserted into the guide funnel.

Here, fully inserted means that that the guide pin is inserted until it stops (i.e. not necessarily until the entire guide pin is inserted).

In an embodiment of the second aspect of the invention, the guide pin and/or the guide funnel exhibits a tapered face. Moreover, the guide pin comprises a head portion at its front end and a stem portion between the head portion and its base. The head portion exhibits a larger diameter than the stem portion.

Preferably, the head portion has a convex shape at its outer diameter.

In an alternative embodiment of the second aspect of the invention, the guide pin and/or the guide funnel exhibits a tapered face and the guide funnel has a radially inwardly protruding collar, past which a cylindrical part of the guide pin is adapted to travel upon insertion in the guide funnel.

In embodiments of the second aspect of the invention, the first or second section, whichever comprises the section body movement arrangement, has a section body guiding arrangement adapted to guide the first or second section body along a first movement path between the disengaged and engaged position. The first movement path comprises two movement path sections. The movement path section being closest to or including the disengaged position exhibits less freedom of movement in transverse directions which are transverse to the first movement path, than the movement path section being closest to or including the engaged position.

Moreover, the section body guiding arrangement can in such embodiments comprise a guide slot in a plate which is part of the section body and a guide member which is fixed. The guide member can comprise a guide portion extending through the guide slot and an end flange limiting said transverse directions. A freedom limitation element is then fixed to the plate having the guide slot and is positioned between the plate and end flange along the movement path section being closest to or including the disengaged position.

According to a third aspect of the present invention, there is provided a method of connecting a set of first connectors with a set of second connector(s) of a subsea connection assembly, the connectors being high voltage wet-mate connectors. The set of first connector(s) is in connection with a first alignment plate and the set of second connectors is in connection with a second alignment plate. One of the first and second alignment plates has a guide pin and the other a guide funnel that are adapted to engage upon a mutual movement of the alignment plates towards each other. The method comprises the following step:

a) with a first movement, moving the alignment plates, along with the connected connectors mutually towards each other, thereby engaging the guide pin and the guide funnel, and thereby arranging the alignment plates in a mutually aligned position;

According to the third aspect of the present invention, the method further comprises the following step:

b) with a second movement, moving the set of first connector(s) and the set of second connector(s) into a connected mode, while the alignment plates remain in said aligned and non-moving position.

Thus, although the set of first or second connectors are in connection with the first alignment plate, the first or second connectors can be moved in their axial direction, i.e. moved with respect to the first alignment plate, towards and away from their facing connectors. Typically, the first connectors can be male connectors which are moved into female connectors which are supported in the second alignment plate.

In an embodiment of the third aspect of the invention, the method further comprises the following steps, while the alignment plates remain in said aligned and non-moving position:

c) moving said set of first connector(s) and set of second connector(s) out of the connected mode and into a disconnected mode; and d) with another second movement, moving an auxiliary set of first connector(s) and an auxiliary set of second connector(s) into a connected mode.

Typically, this embodiment will include two facing alignment plates which both have a set of first and second connectors that are operated with a connector movement arrangement, and an auxiliary set of first connectors and auxiliary set of second connectors that can be moved with the connector movement arrangement (such as a stroke tool) or with an auxiliary connector movement arrangement. A typical embodiment would be to have two electrical high voltage three-phase connections independently operable, thereby being able to route electric power to different consumers.

According to a fourth aspect of the present invention, there is provided a subsea high voltage, meaning voltages of 1 kV and above, wet mate connector assembly comprising a male connector having a male connector main body and a female connector having a female connector main body. The male and female connectors are adapted to be joined into an engaged position and separated out to a disengaged position. In the engaged position the male connector is aligned with the female connector and the male connector main body and the female connector main body remain in a constant mutual position. According to the fourth aspect of the present invention, when in said engaged position, a contact pin of the male connector is adapted to move between a connected position, in which it is inserted into a contact bore of the female connector, and a disconnected position, in which it is retracted into the male connector.

In an embodiment of the fourth aspect of the invention, the contact pin comprises an electric conducting contact face that faces in a radial direction with respect to the axial direction of the contact pin. The contact face is in electric contact with a radially inner face of a bore conductor which constitutes part of said contact bore when the contact pin is in the connected position. Moreover, the contact pin comprises a male isolation head at its front end, which male isolation head constitutes a radial isolating face along a distance between the contact face and the front of the contact pin.

In such an embodiment, the female connector can comprise a female isolation head arranged in the contact bore. The female isolation head abuts the male isolation head both in the connected position and in the disconnected position.

In the disconnected position, the contact face is preferably confined and protected radially within an isolating protection sleeve and axially by said male isolation head and an isolating sleeve. The isolating sleeve is part of the contact pin. Moreover, the face of the bore conductor which is adapted to contact the contact face in the connected position, is advantageously confined and protected radially by a sleeve portion.

With the term protected is meant that the contact face is protected from environmental damage, such as from intrusion of seawater. This feature provides the possibility to lower the connectors into seawater without needing to attach protective caps on them. Consequently, when installing the connectors, the operator will not need the time or space for removing the caps prior to establishing the connection (i.e.t moving into the connected mode).

Moreover, when in the engaged position and the disconnected position, an axially facing male connector forward face can surround a front face of the contact pin, while an oppositely axially facing female connector forward face surrounds a corresponding front face of a female isolation head. The male connector forward face then abuts the female connector forward face and the front face of the contact pin abuts the front face of the female isolation head. A respective seal surrounds and seals against radially facing faces of the male isolation head and the female isolation head.

At least one of the male connector main body and the female connector main body can have an axially extending portion with a cylindrical outer surface which is arranged within and with a radial distance from a cylindrical inner surface of an axially extending portion of an attachment body. Then a flexible body can be arranged between the cylindrical outer and inner surfaces.

Such a flexible body will provide mutual compliance between the male and female connector.

The flexible body can substantially exhibit a cylinder shape. In one embodiment, the flexible body is made of a corrugated sheet material. The material can for instance be rubber or plastic, however more rigid materials are also possible, particularly when using a corrugated design.

The male connector and/or the female connector can preferably comprise a first liquid chamber and a second liquid chamber between which a liquid communication exists. The second liquid chamber is adapted to receive a protective liquid from the first liquid chamber upon movement of the contact pin from the disconnected position to the connected position.

The protective liquid is a liquid suited for protection of the internal surfaces of the connector, as well as electric insulation. Thus, an appropriate liquid may be oil. The flow of protective liquid from the first liquid chamber to the second liquid chamber results from displacement of the liquid in the first chamber upon movement of the contact pin. Oppositely, when the contact pin is pulled back into the disconnected position, protective liquid flows from the second liquid chamber, back to the first liquid chamber.

An annular piston can advantageously constitute a movable confinement of the second liquid chamber and can be arranged between a third liquid chamber and the second liquid chamber. The third liquid chamber is in liquid communication with the exterior of the male and/or female connector.

The third liquid chamber may in some embodiments communicate directly with the ambient seawater, possibly through a sieve or other filter means. In other embodiments, however, one can also imagine a liquid compensation container, such as a metal bellows, arranged exterior to the connector and with which the third liquid chamber communicates.

A movable and spring-loaded piston can constitute a partition between the third liquid chamber and the protective liquid. Then, a biasing spring can be biased to exert a biasing force on the spring-loaded piston.

EXAMPLE OF EMBODIMENT

While the invention has been outlined in general terms above, a more detailed and non-limiting example of embodiment will be presented in the following, with reference to the drawings, in which FIG. 1 is a schematic illustration of two large subsea modules which are interconnected with a subsea connection assembly according to the present invention;

Figures 11A, 11B, 11C, 11D, 11E, 11F:
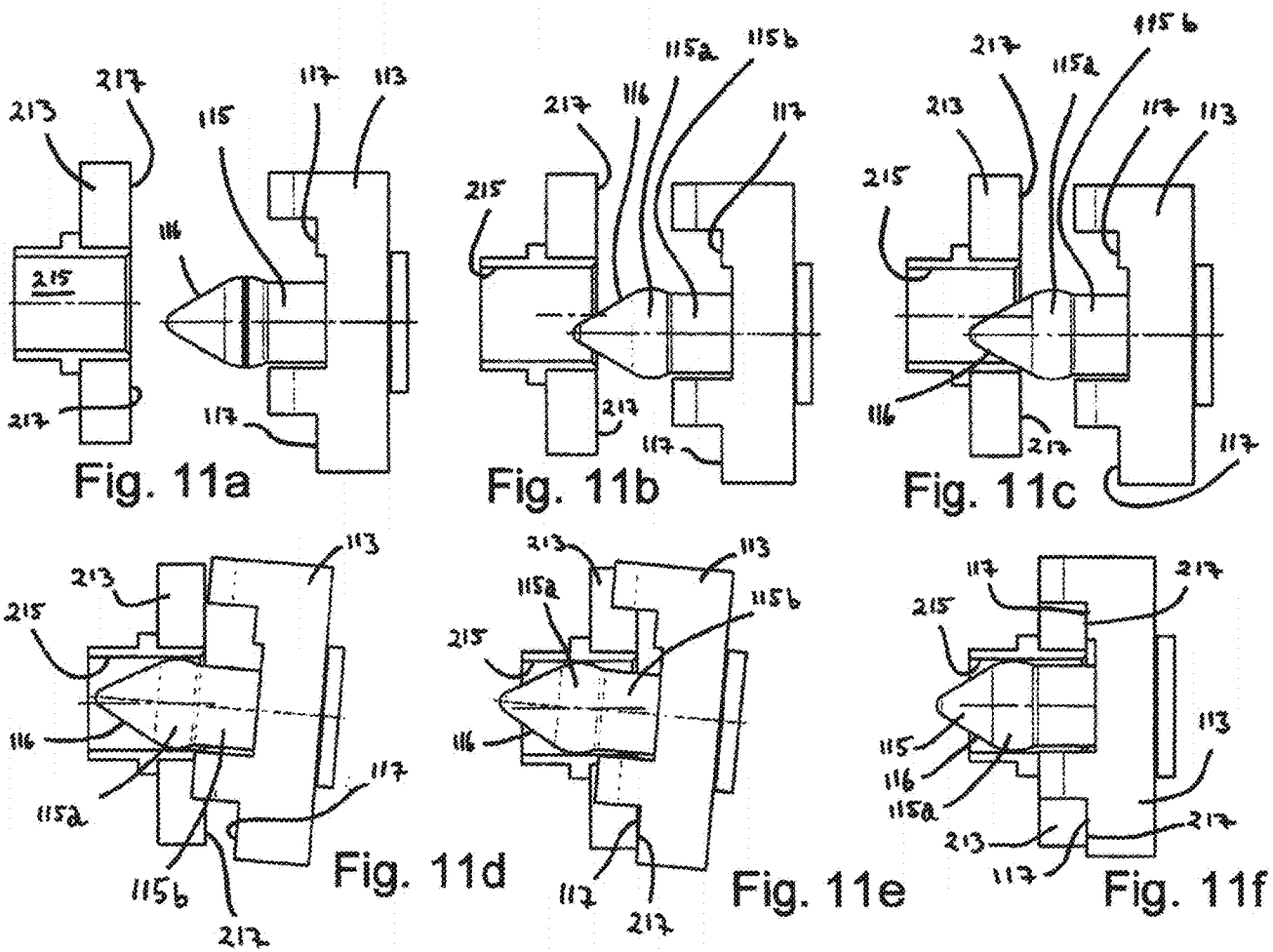
Figure 14:
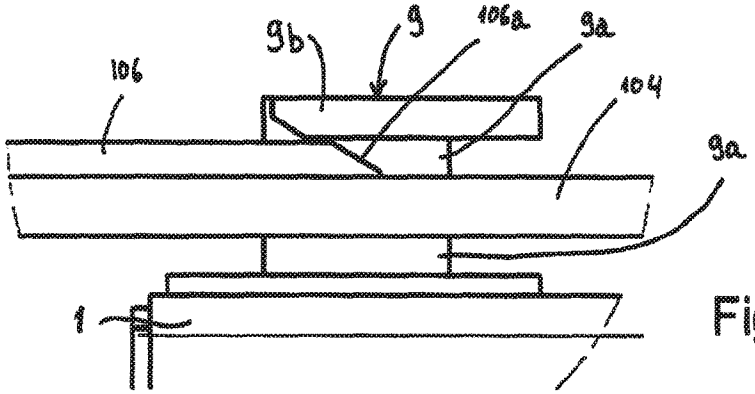
Figure 11G:
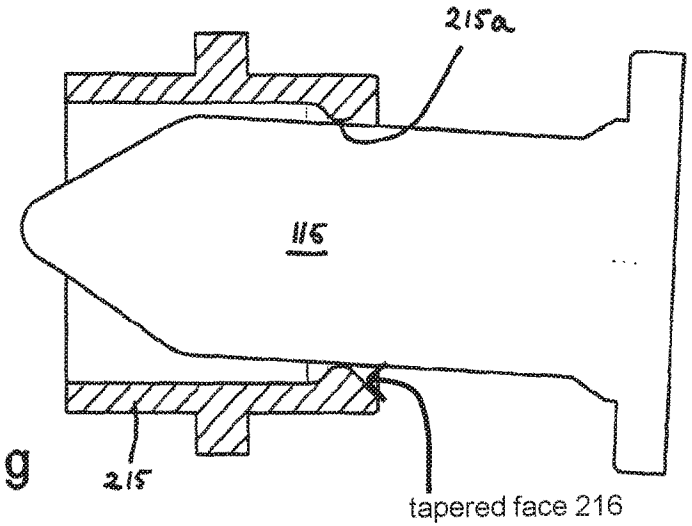
Figure 12A:
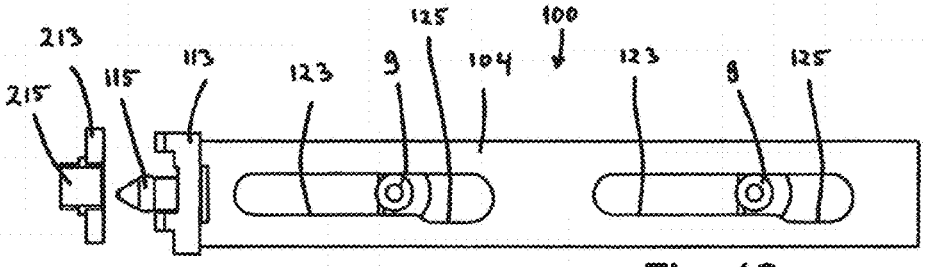
Figure 12B:
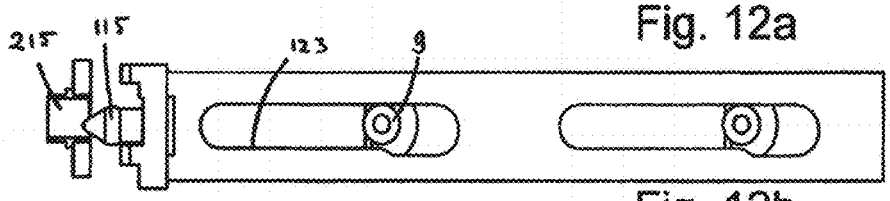
Figure 12C:
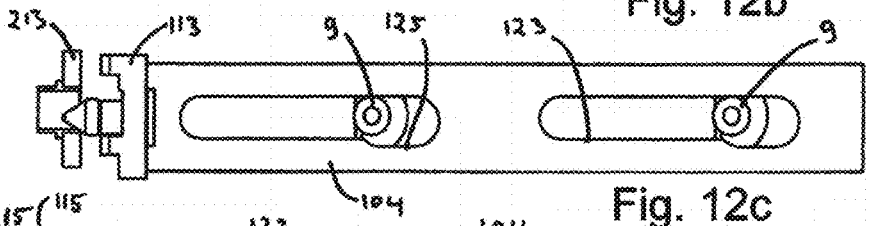
Figure 12D:
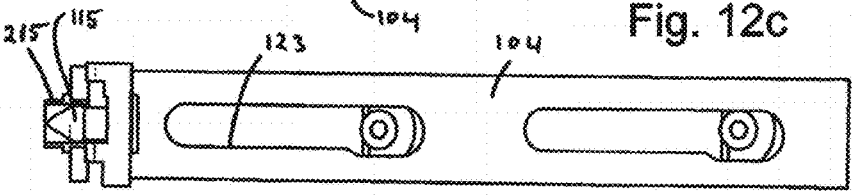
Figure 12E:
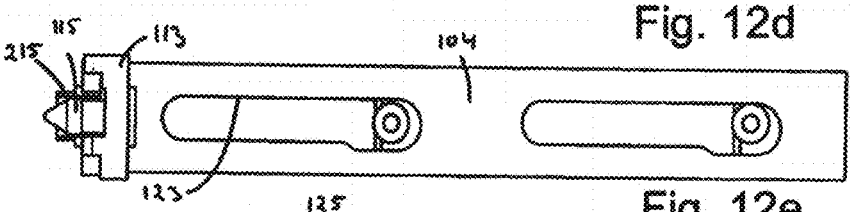
Figure 12F:
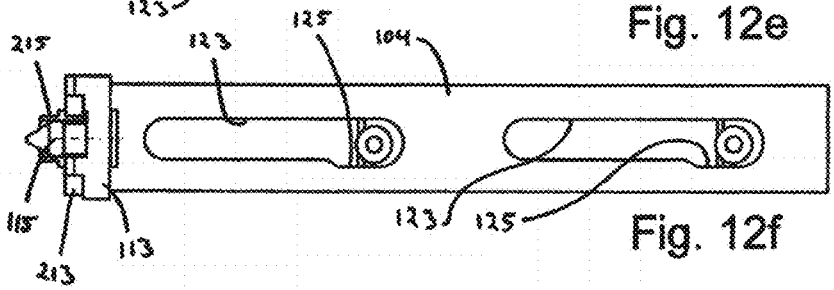
Figure 13:
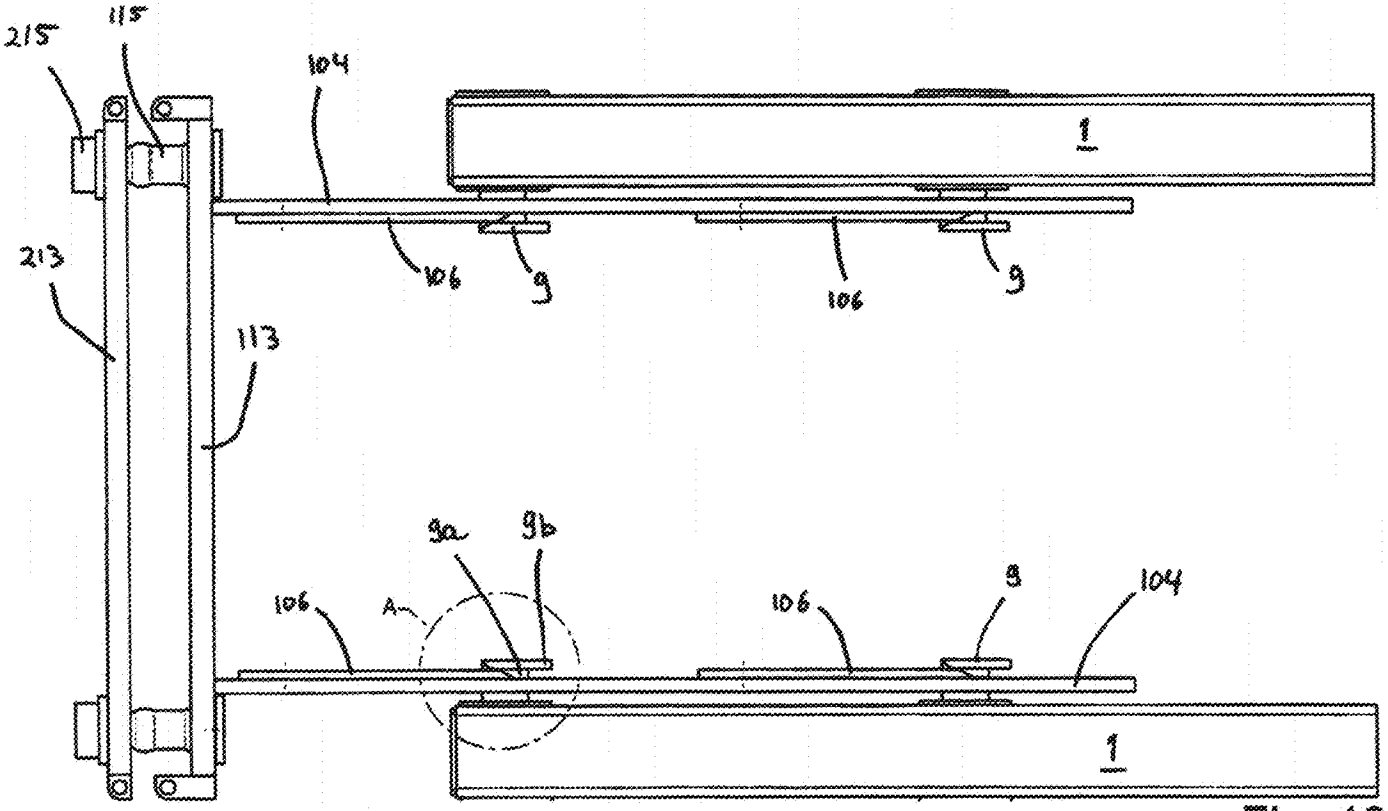
Figure 15:
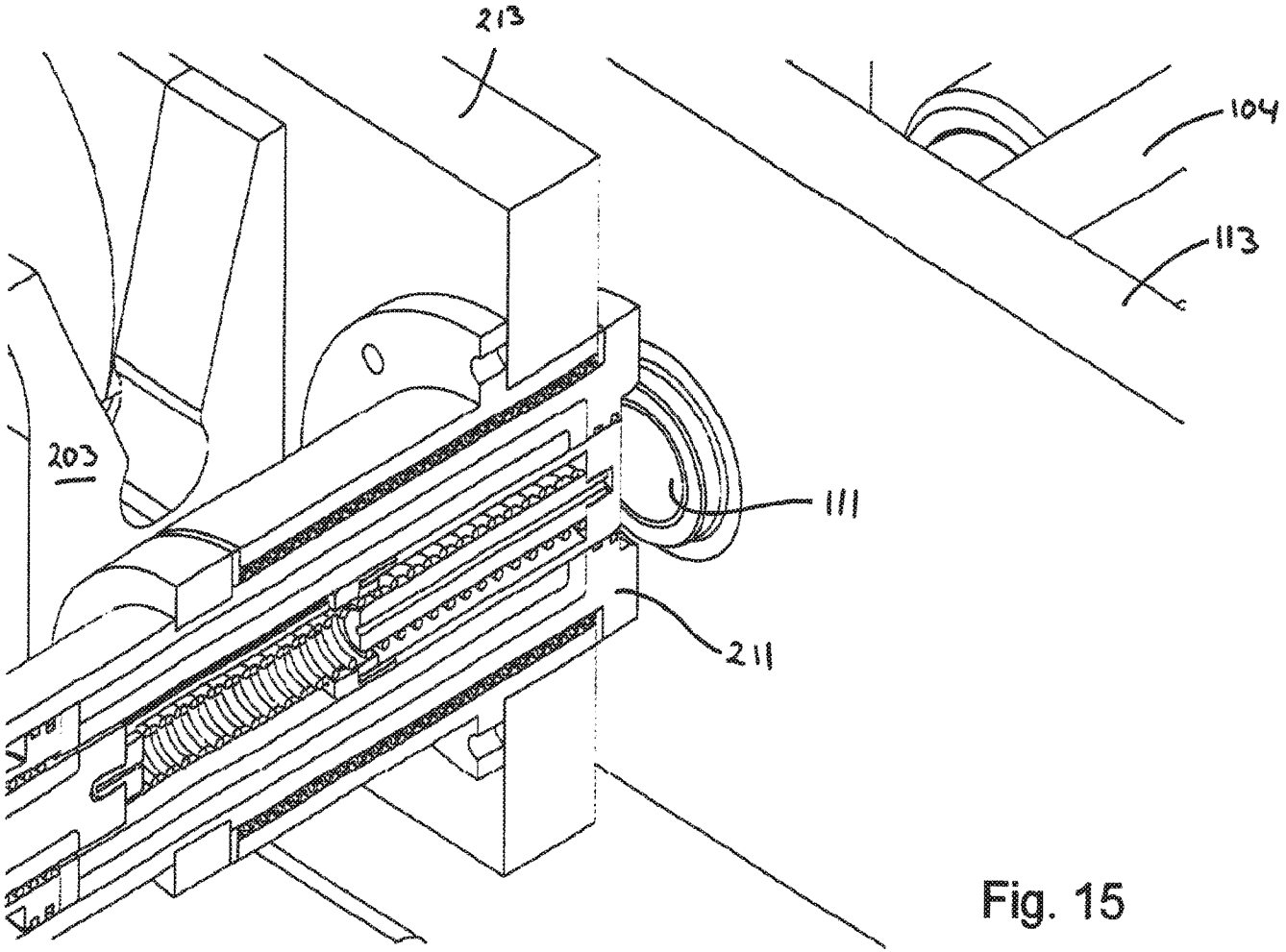
Figure 17:
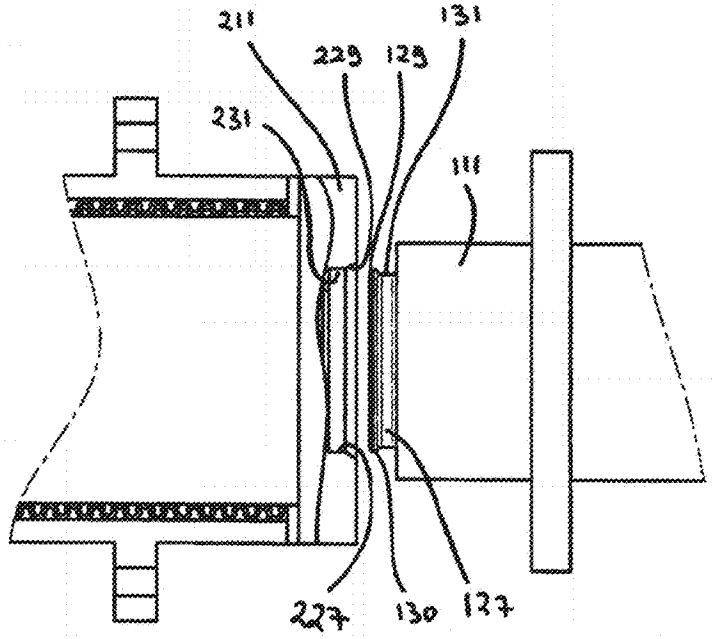
Figure 16:
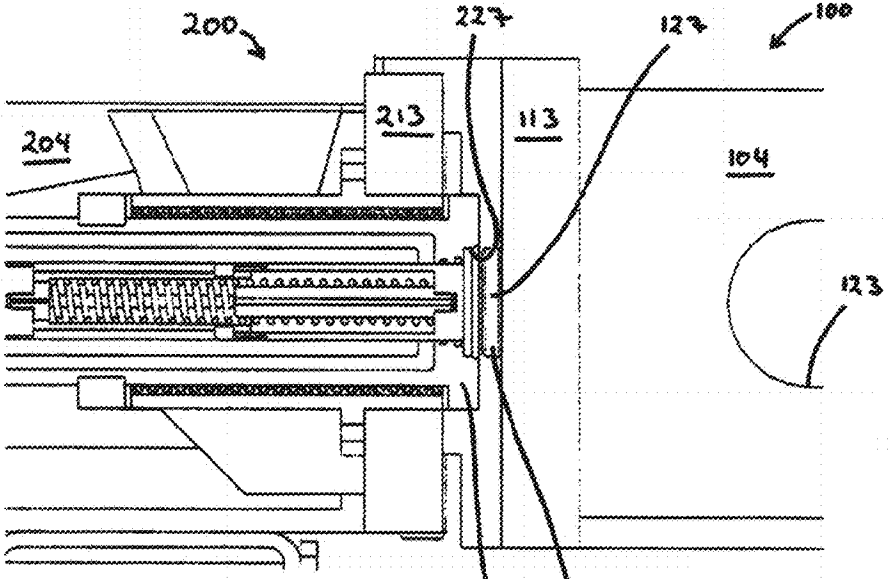
Figure 18:
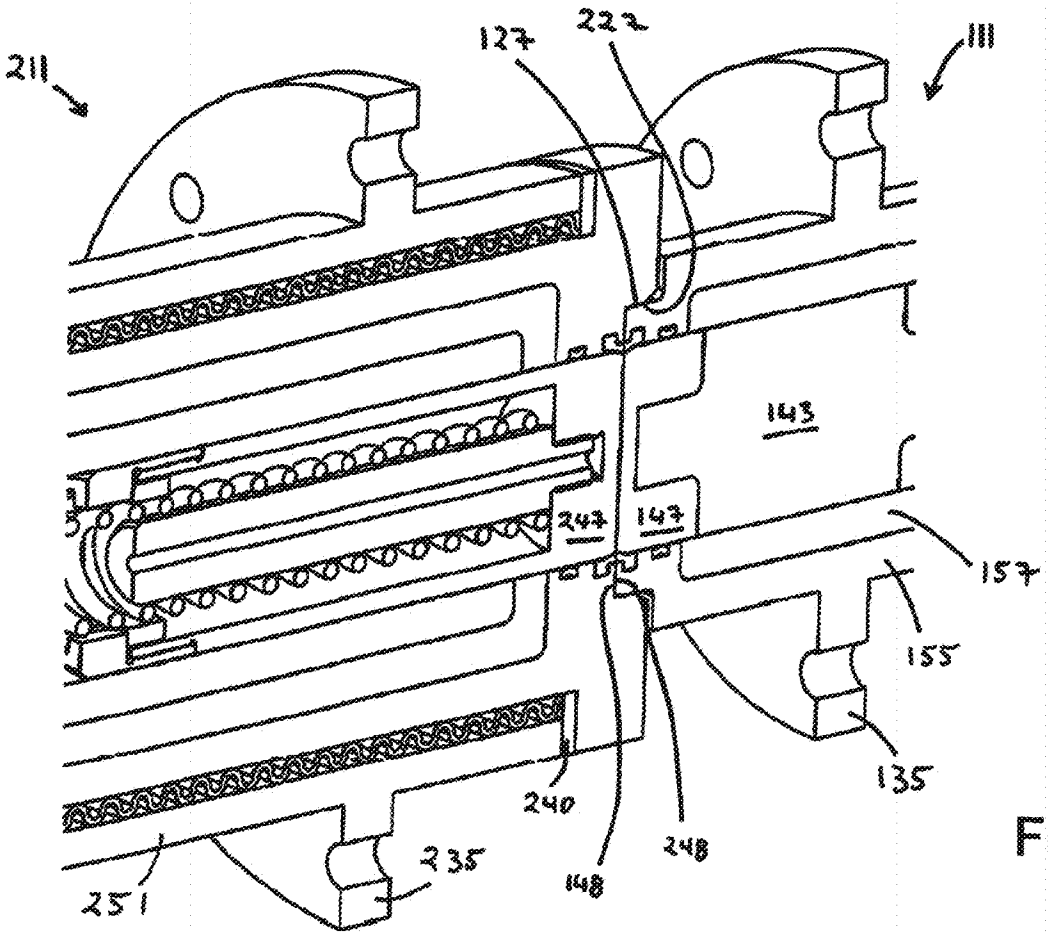
Figure 19:
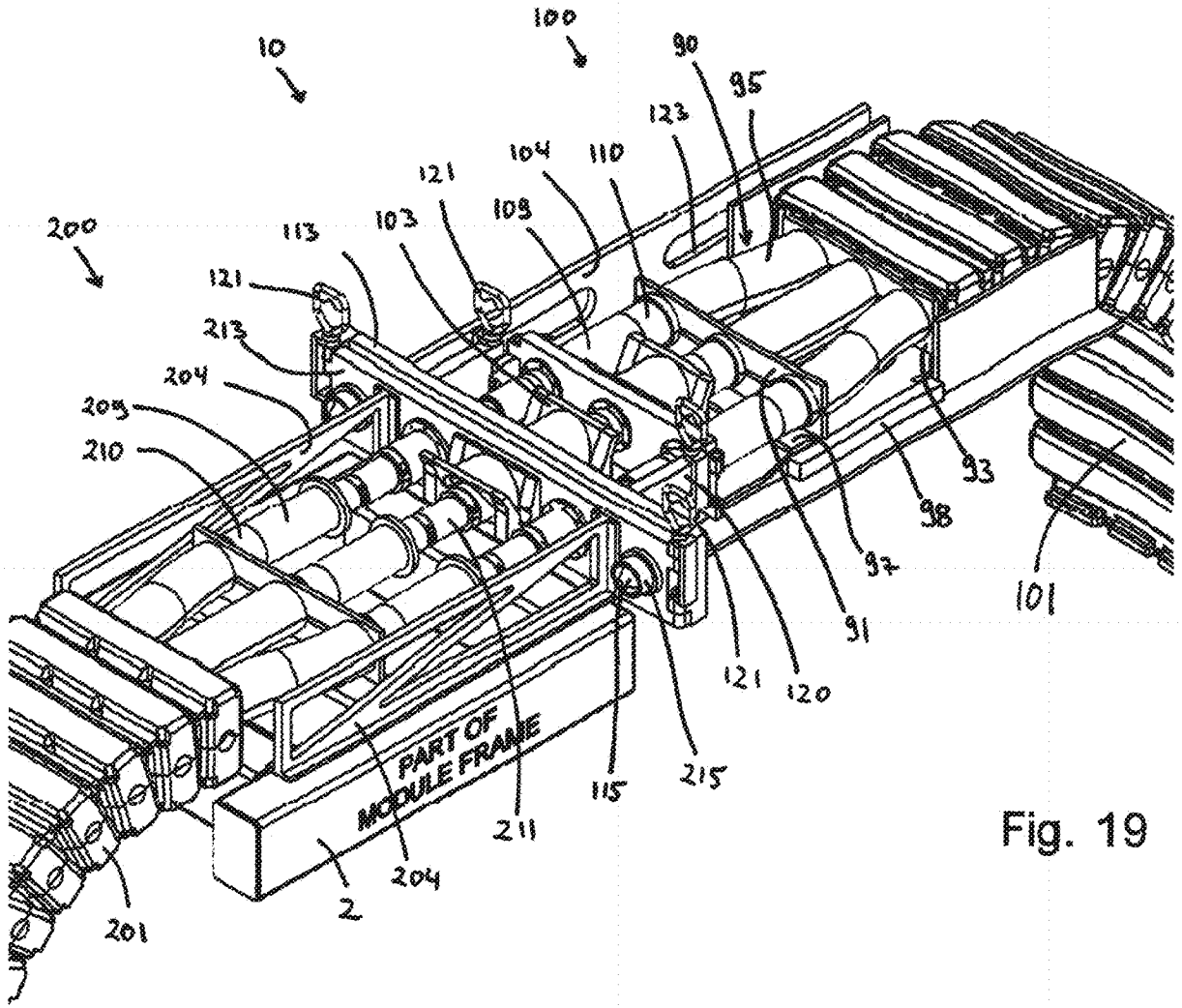
Figure 20:
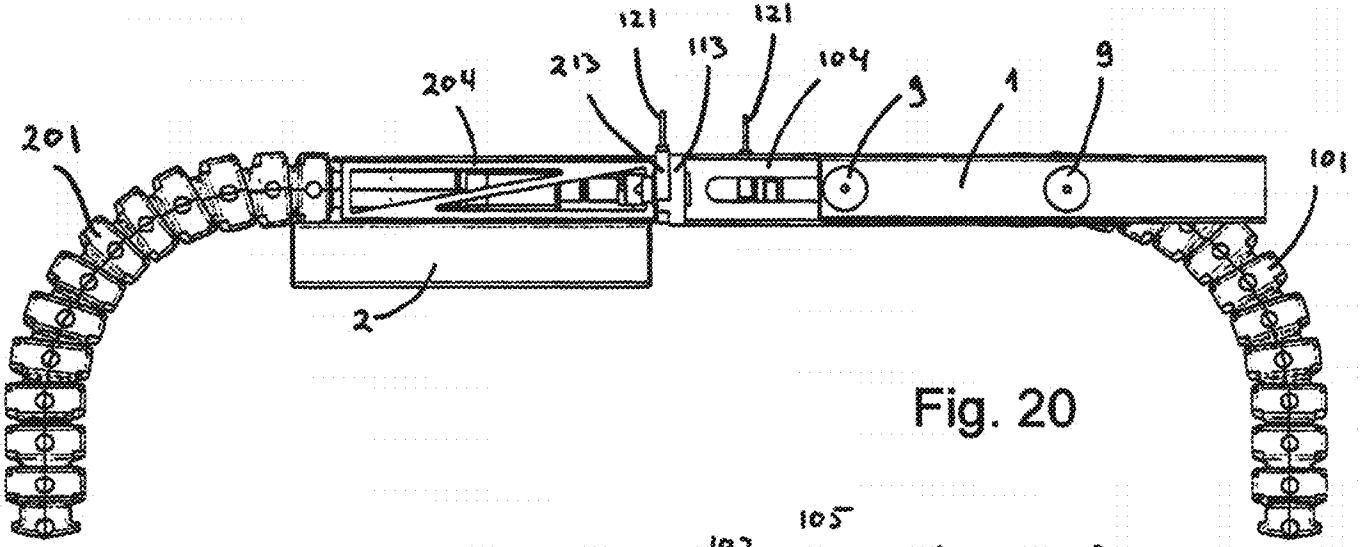
Figure 21:
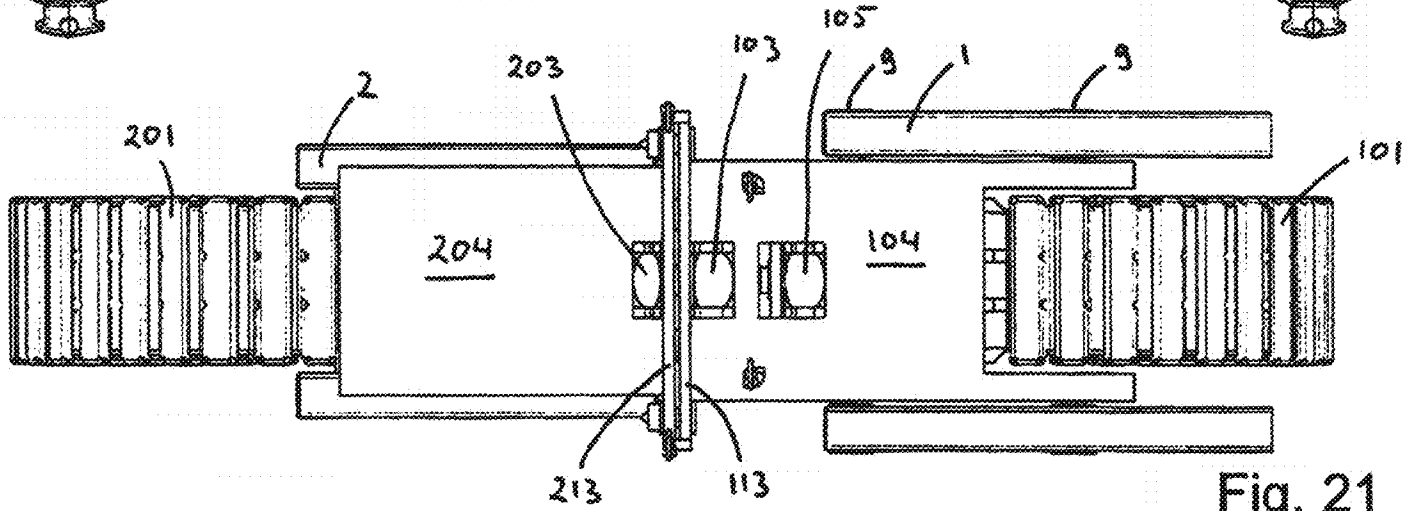
Figure 22:
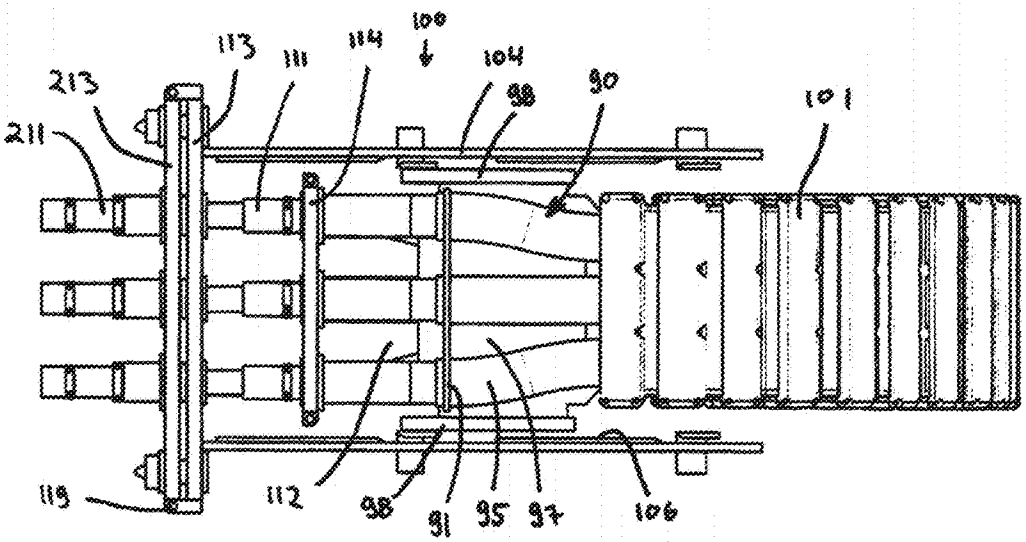
Figure 23:
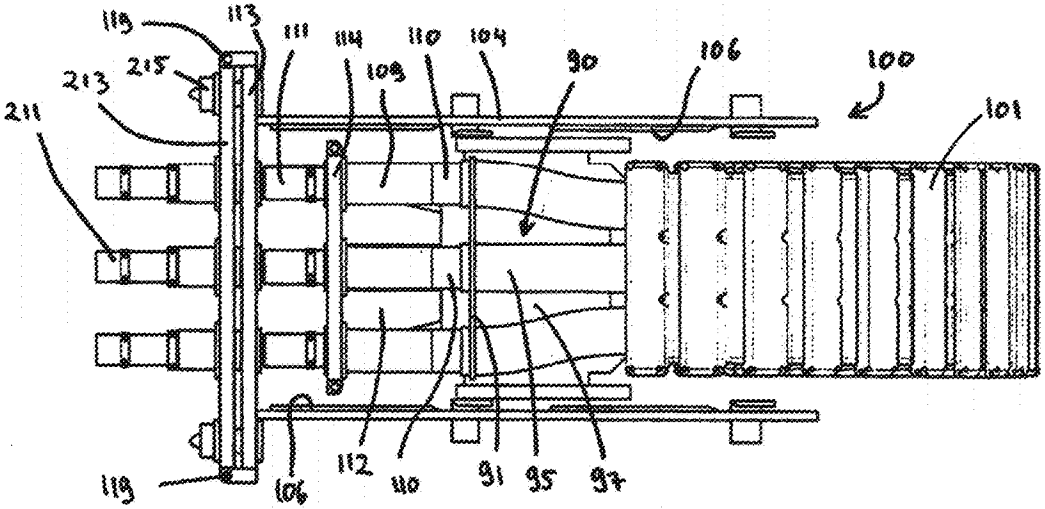
Figure 24:
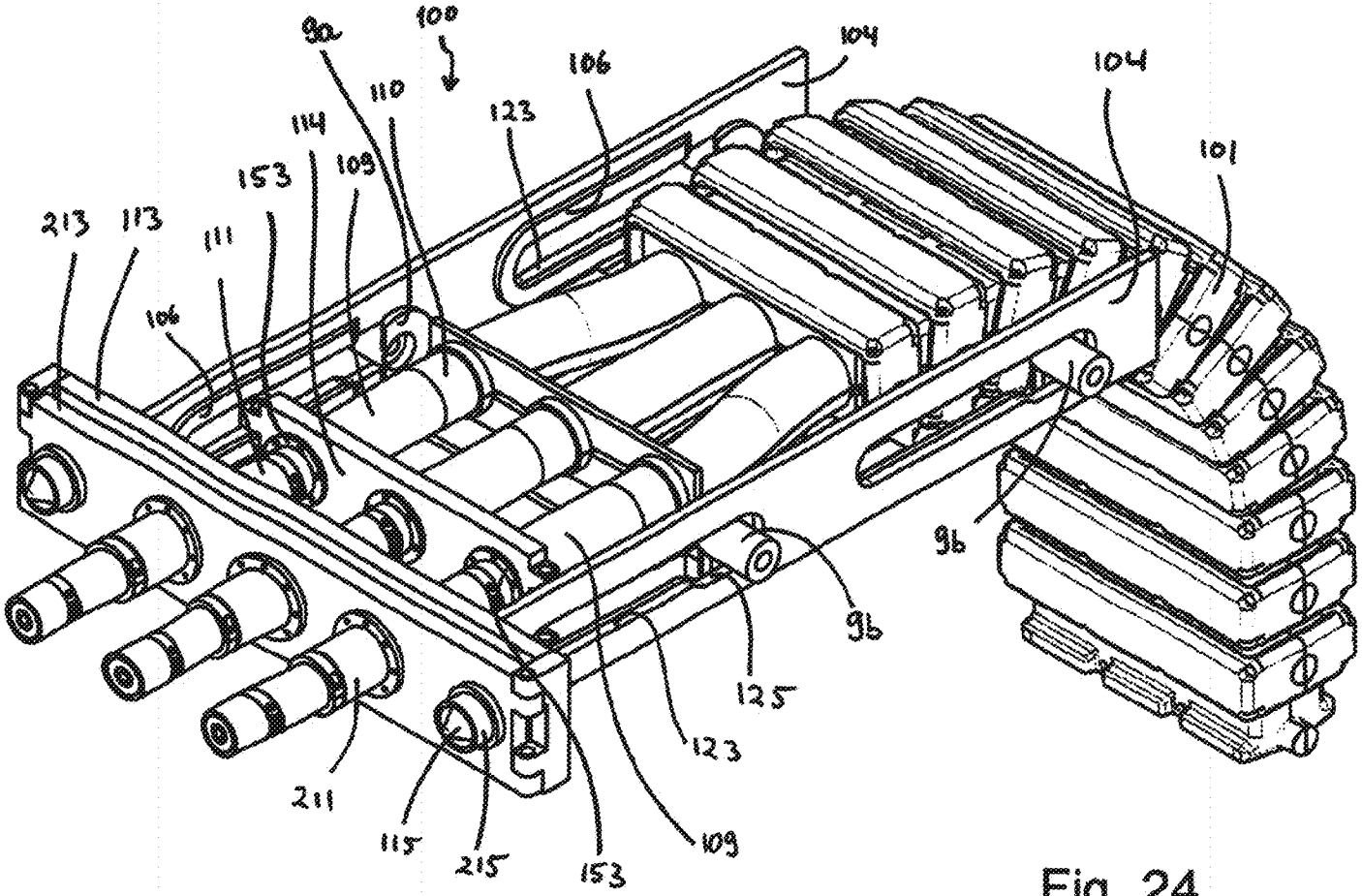
Figure 25:
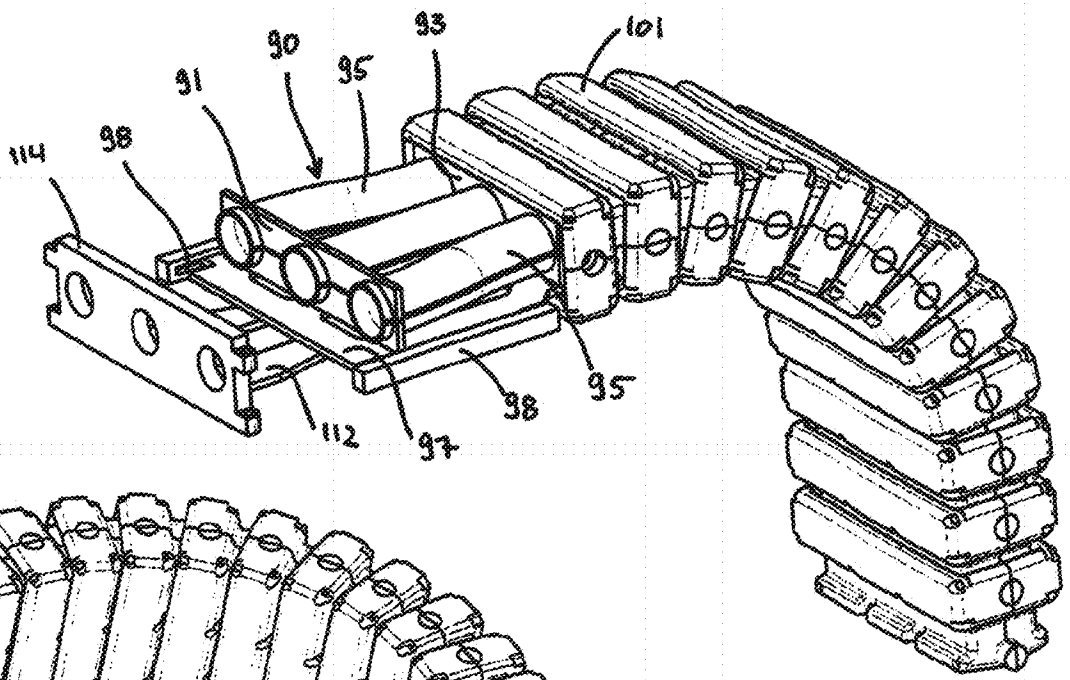
Figure 26:
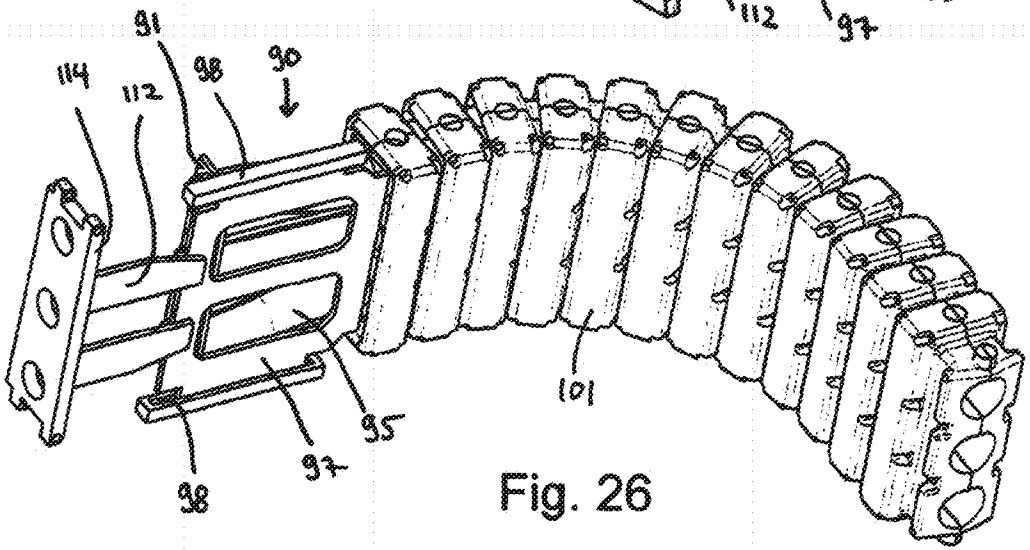
Figure 26A:
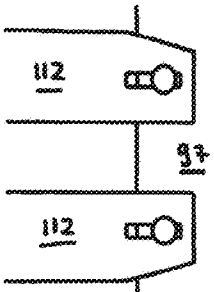
Figure 28:
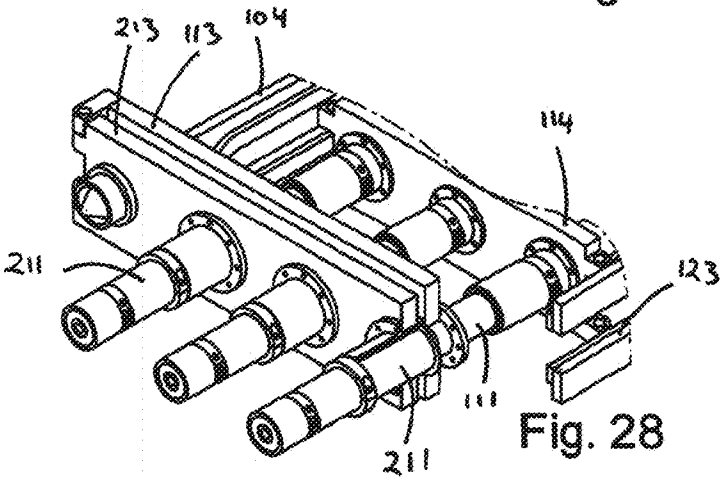
Figure 27:
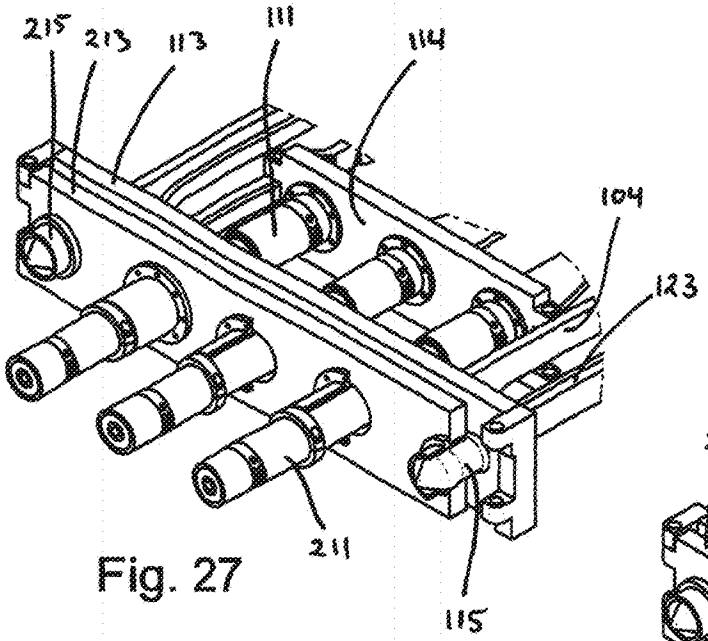
Figure 29:
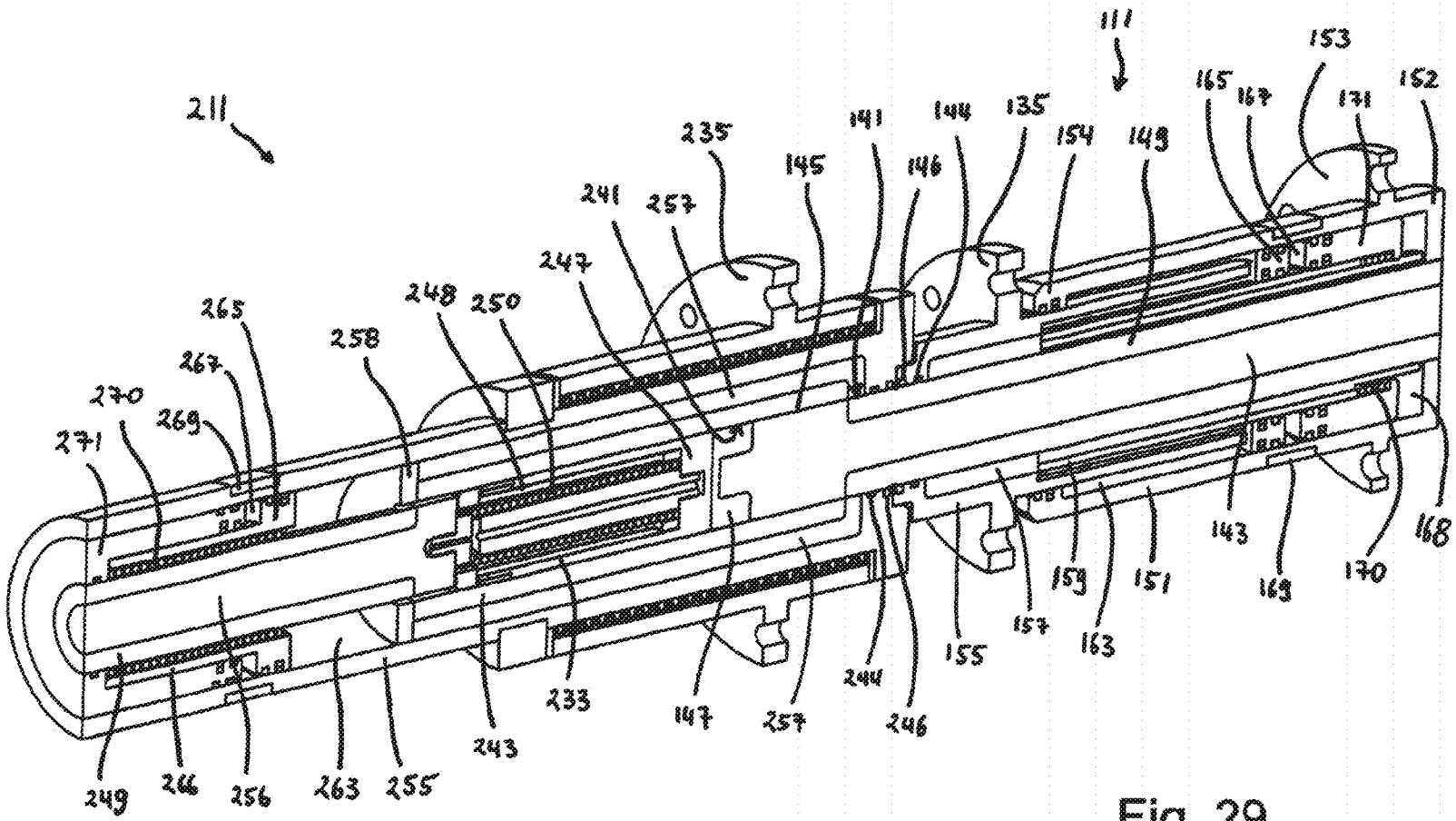
Figure 30:
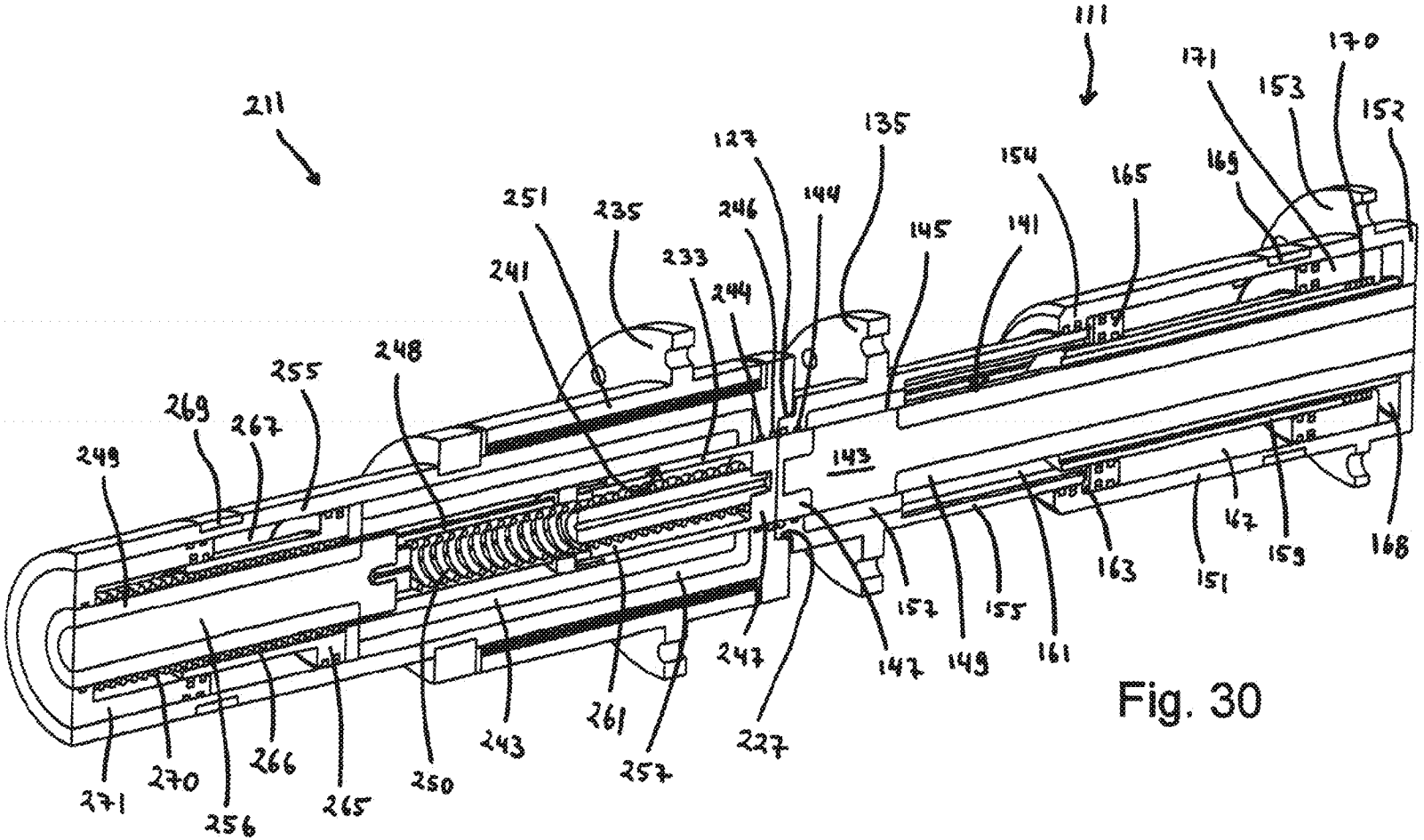
Figure 31:
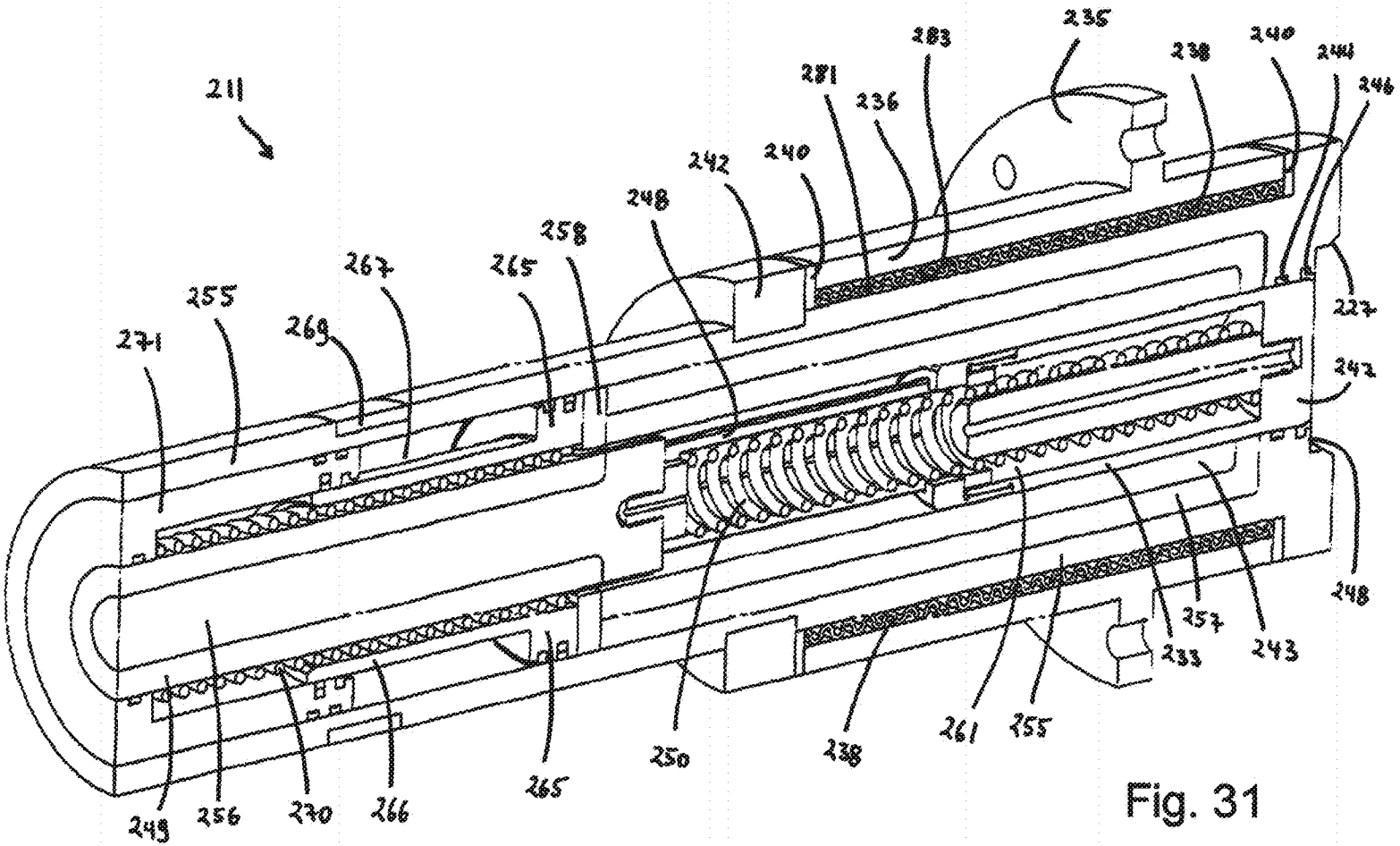
Figure 32:
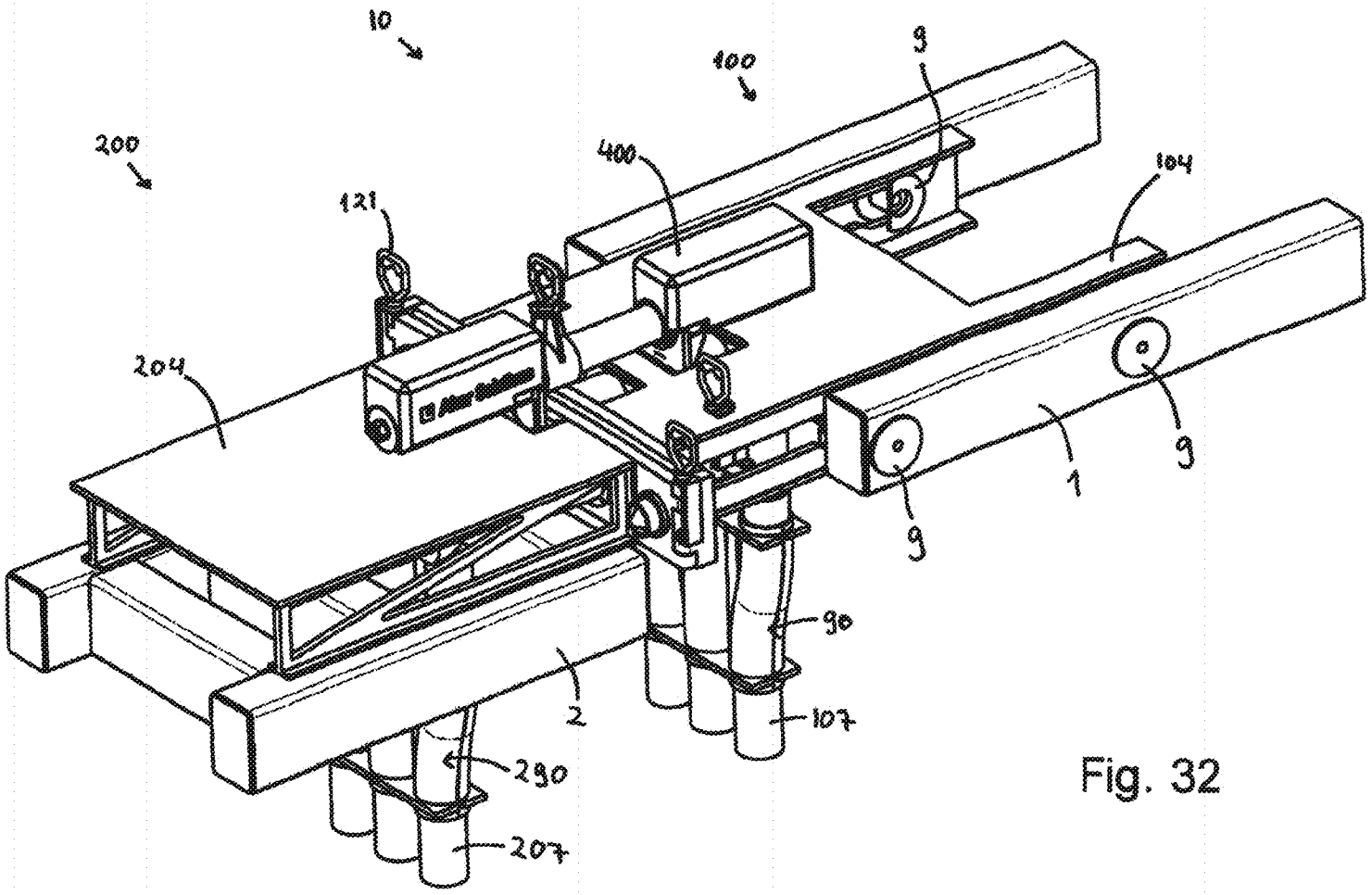

FIG. 11*a* to FIG. 11*f* are principle cross section view through a guide pin and guide funnel of two alignment plates, showing steps from an initial non-aligned position to a final aligned position;

FIG. 11*g* is a principle cross section side view of an alternative embodiment of a guide pin and guide funnel;

FIG. 12*a* to FIG. 12*f* are side views of situations a first section body and an opposite alignment plate, corresponding to the positions shown in FIG. 11*a* to FIG. 11*f*, respectively;

FIG. 13 is a top view of a first section body and an oppositely arranged alignment plate, illustrating movement of the first section body;

FIG. 14 is an enlarged portion of the top view of FIG. 13, illustrating a movement guiding means of the first section body;

FIG. 15 is an enlarged perspective view showing a female connector with a cross section view;

FIG. 16 is a cross section side view illustrating the same situation as in FIG. 15;

FIG. 17 is principally an enlarged view of a part of FIG. 16, showing however an alternative embodiment of the front portion of a connector;

FIG. 18 is an enlarged perspective cross section view illustrating the interface between a male and a female connector after a first and before a second stage of the connection process;

FIG. 19 is a perspective view of the subsea connection assembly according to the invention after the first stage of the connection process, with some parts removed for illustrational purpose;

FIG. 20 is a side view of the subsea connection assembly according to the invention;

FIG. 21 is a top view of the subsea connection assembly shown in FIG. 20;

FIG. 22 is a top view of most of a first section and some of the second section of the connection assembly, after the first and before the second stage of the connection process;

FIG. 23 is a top view corresponding to FIG. 22, however after the second stage of the connection process;

FIG. 24 is perspective view of the parts shown in FIG. 22, with some parts removed for illustrational purpose;

FIG. 25 is a perspective view of some interconnected components of the first section of the assembly;

FIG. 26 is another perspective view of the components shown in FIG. 25, however from another angle;

FIG. 26*a* is a principle view of a flexible connection between a connection plate and a lower support plate;

FIG. 27 is an enlarged perspective view of two aligned alignment plates and associated connectors, with a guide funnel shown in a cross section view;

FIG. 28 is an enlarged perspective view corresponding to FIG. 27, however with two alignment plates shown in a cross section view;

FIG. 29 is a perspective cross section view through a male and a female connector in a connected state;

FIG. 30 is a view corresponding to FIG. 29, however in a non-connected state;

FIG. 31 is a perspective cross section view of the female connector in FIG. 30; and FIG. 32 is a perspective view of an alternative embodiment of the present invention, wherein the penetrators exhibit a 90 degree bend.

Figure 1:
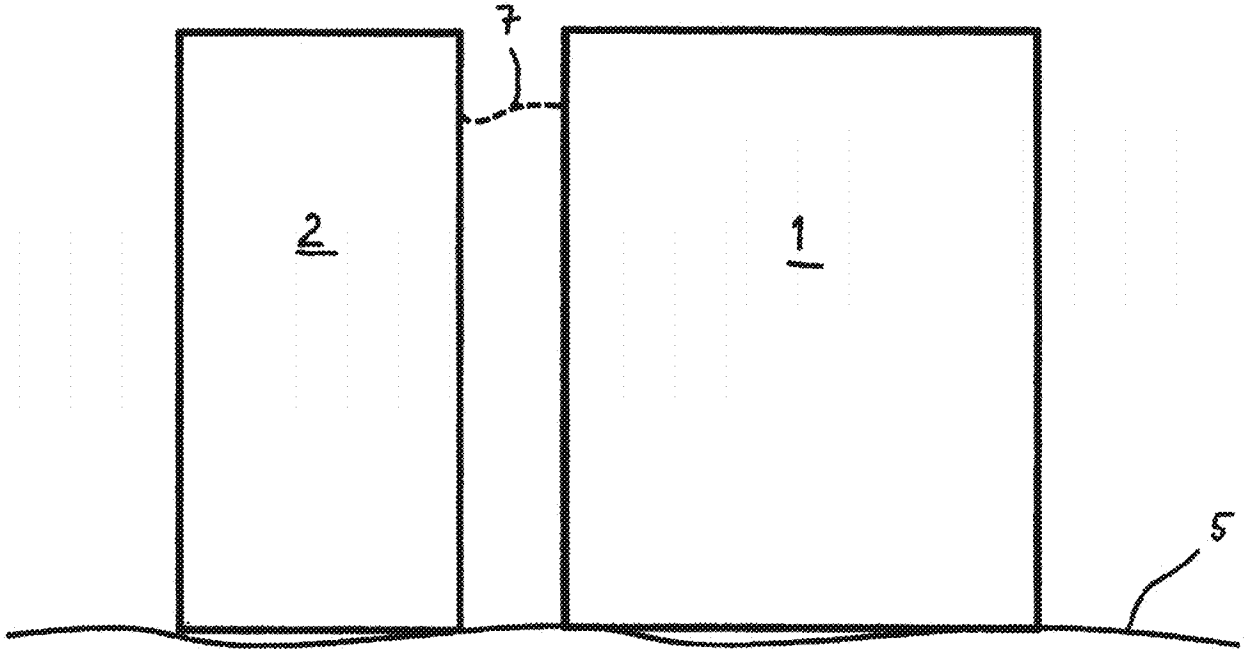

FIG. 1 illustrates schematically two large modules, namely a first module 1 and a second module 2, arranged on the seabed 5. The modules 1, 2 can for instance be parts of a subsea compression facility which is adapted to boost the pressure of hydrocarbons produced in a subsea well. One such module can for instance have dimensions 8×12×17 meters (width×height×depth). Due to their considerable size, they must be installed separately on the seabed. After installation, communication is established between them, such as with high voltage and/or low voltage lines, and control lines. A three-phase high voltage line 7 is schematically indicated with the dotted line.

Figure 2:
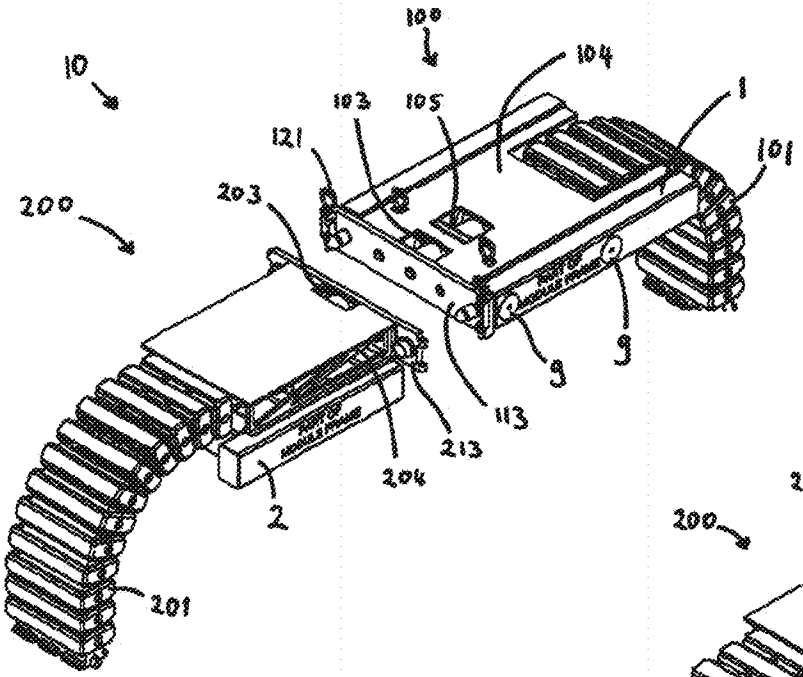
FIG. 2 is a perspective view of a subsea connection assembly according to the invention, in a situation before initializing a connection process.

FIG. 2 illustrates an embodiment of a subsea connection assembly 10 according to the present invention. It comprises a first section 100 and a second section 200. In FIG. 2 the subsea connection assembly 10 is shown in a non-connected mode.

In this example of embodiment, the first section 100 is arranged to a first support structure in the form of the first module 1, illustrated in FIG. 1, while the second section 200 is arranged to a second support structure, here in the form of the second module 2. In FIG. 2 the first and second modules 1, 2 are indicated only with beams that are fixed portions of the respective modules 1, 2.

Out from rear portions of the first section 100 and second section 200 extend bend restrictors 101, 201 within which a plurality of lines 107 (not indicated in FIG. 2) are arranged. These lines may for instance be electric high voltage lines constituting part of a three phase electric power transmission.

Figure 3:
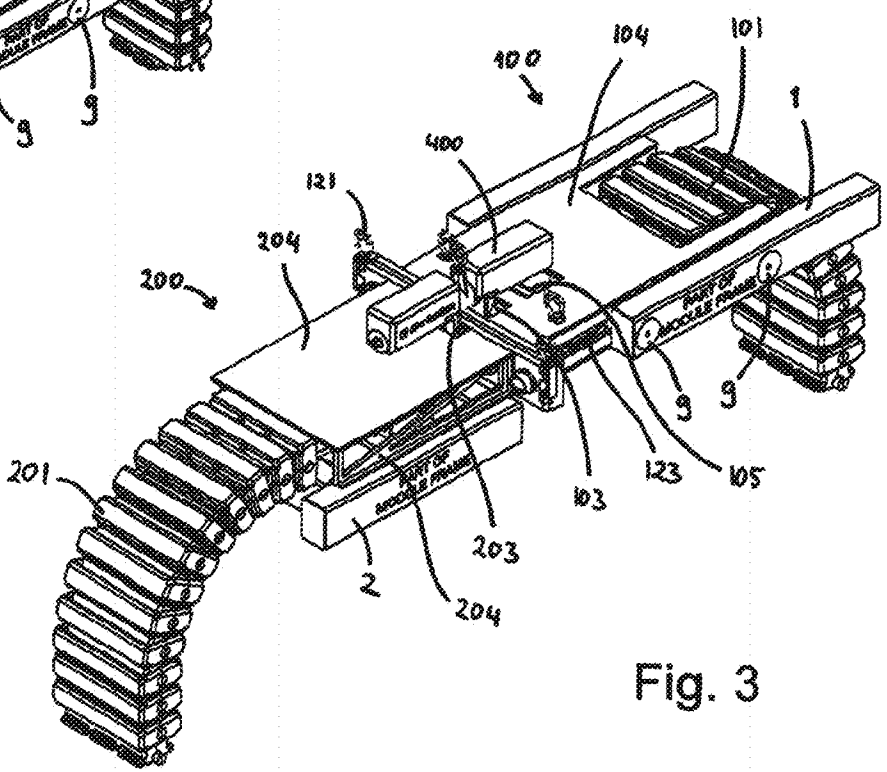
FIG. 3 is a perspective view according to FIG. 2, illustrating the situation after a first stage or first movement of the connection process.

FIG. 3 is a view similar to FIG. 2, showing however also a stroke tool 400 landed on the first and second sections 100, 200. The first and second sections 100, 200 each have a first section body 104 and a second section body 204, respectively. The stroke tool 400 engages a stroke tool interface 103, 203 which is fixed to the first and second section body 104, 204 respectively, and pulls them towards each other. This will be described in further detail below. As one will appreciate from comparison of FIG. 2 and FIG. 3, the first section 100 has moved with respect to the first module 1, while the second section 200 has not moved with respect to the second module 2.

In this embodiment, the stroke tool 400, together with the stroke tool interfaces 103, 203, constitutes a part of a section body movement arrangement, which is adapted for moving one of the section bodies 104, 204 (the first section body 104 in this embodiment) towards and away from the opposite section body. Indeed, one can imagine other means for moving, which may replace the stroke tool 400. This can for instance be a hydraulic piston or electric motor, which may be permanently or temporarily installed.

Figure 4:
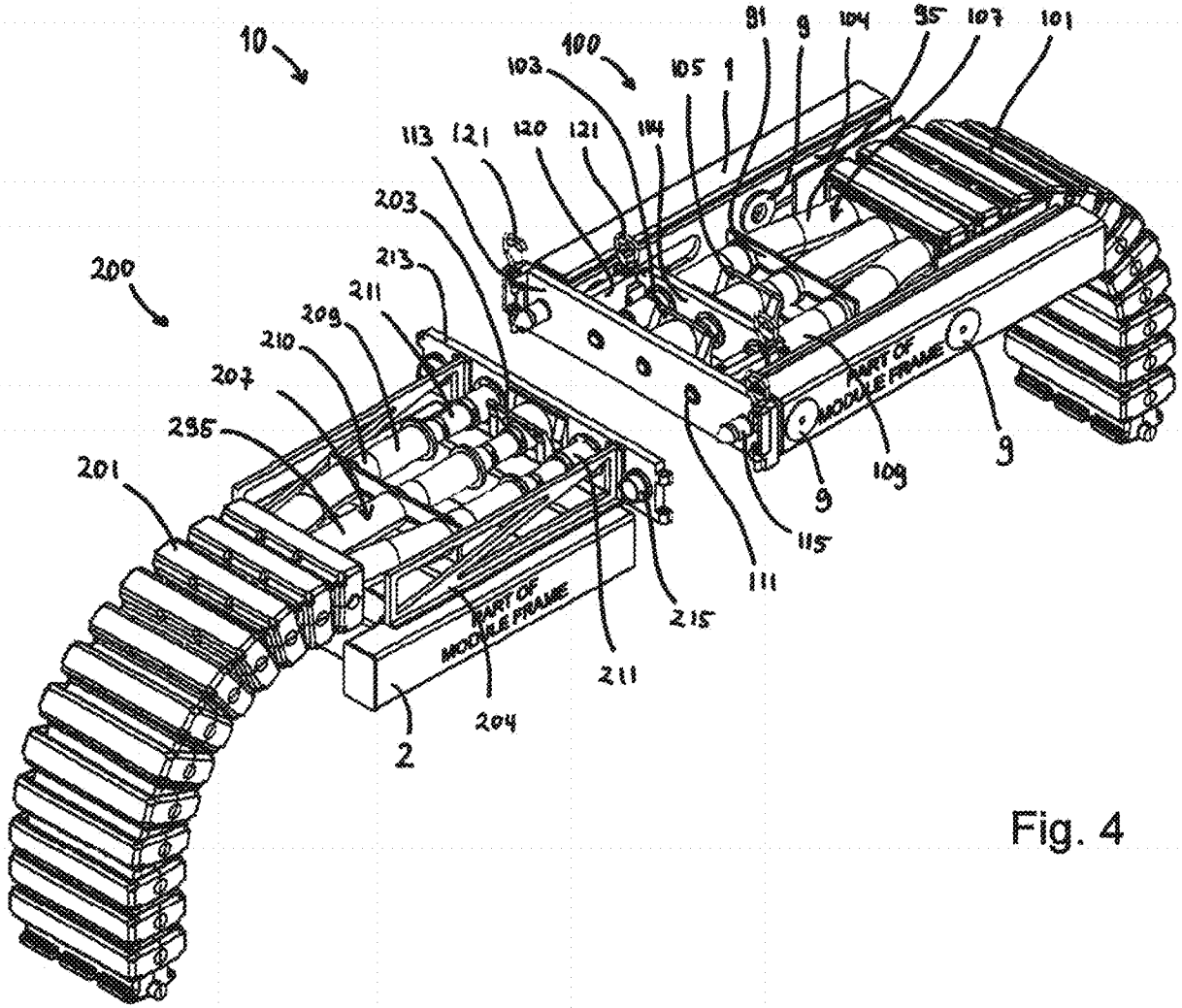
FIG. 4 is another perspective view according to FIG. 2, however with some parts removed for illustrational purpose.

FIG. 4 illustrates the first section 100 and the second section 200 with a top panel removed for illustrational purpose. Each section 100, 200 connects to three lines 107, 207 which extend through the bend restrictors 101, 201 and cable support tubes 95, 295. In this embodiment the lines are electric high voltage lines 107, 207, and hence the connectors are electric connectors (which will be described further below).

In this embodiment, each of the high voltage lines 107 connected to the first section 100 ends in a penetrator 109 and a male connector 111. Similarly, the lines 207 of the second section end in a penetrator 209 and a female connector 211.

Also shown in FIG. 4 is a first alignment plate 113 of the first section 100 and a second alignment plate 213 of the second section 200. The first and second alignment plates 113, 213 are adapted to abut as shown in FIG. 3, when the stroke tool 400 pulls them towards each other.

Figure 5:
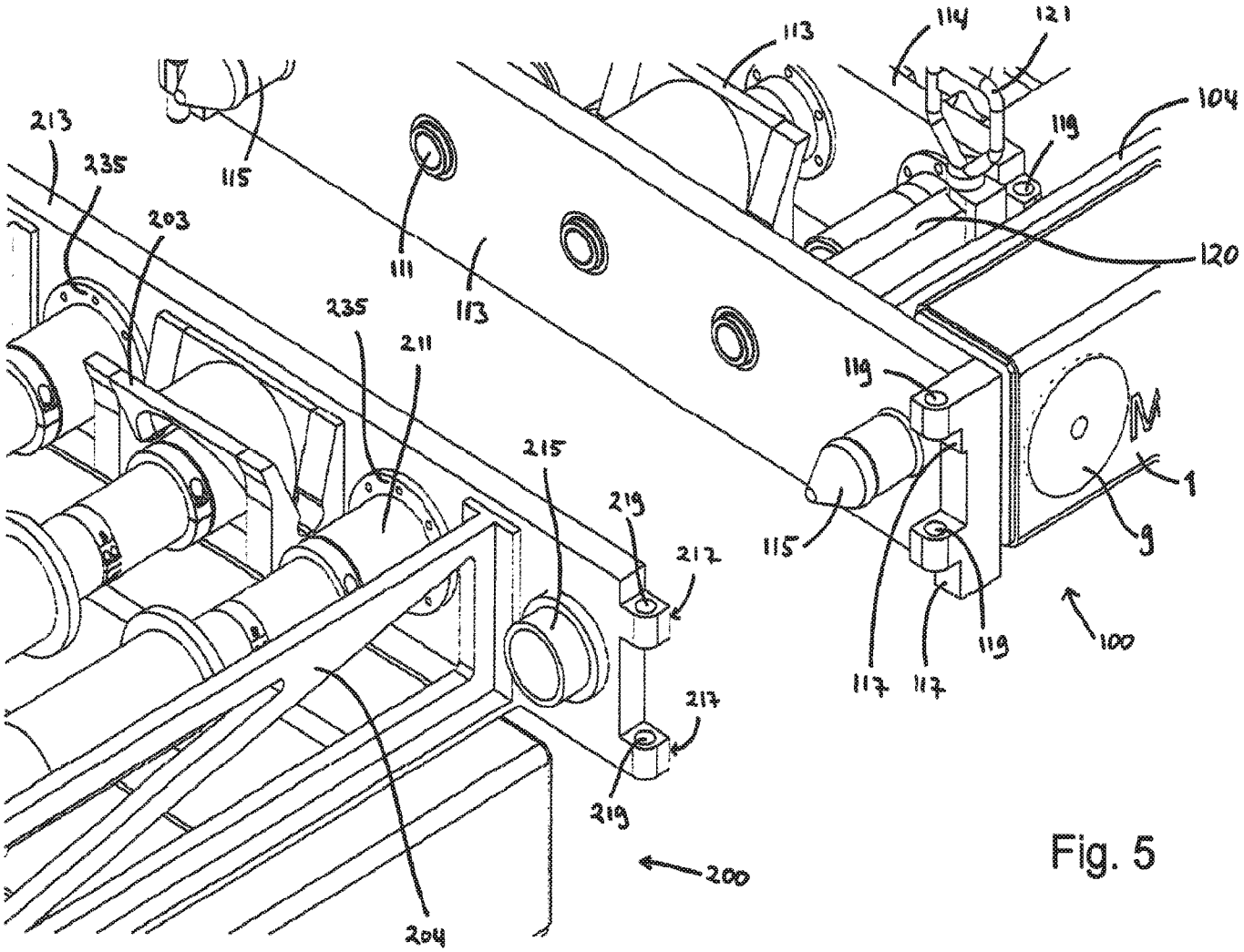
FIG. 5 is an enlarged perspective view of the subsea connection assembly according to the invention, before initiation of the connection process.

To illustrate how the first and second alignment plates 113, 213 become aligned with respect to each other, it is first referred to FIG. 5. In this enlarged perspective view, one will appreciate how a guide pin 115 extending out from the first alignment plate 113 is adapted to enter an oppositely arranged guide funnel 215 on the second alignment plate 213. This will take place when the stroke tool 400 pulls the alignment plates 113, 213 towards each other. Since the end of the guide pin 115 has a tapered face 116 (FIG. 11*a*), the two alignment plates 113, 213 may be misaligned to some extent in the radial direction before stroking them together. Provided the pointed end of the guide pin 115 enters the guide funnel 215, the alignment plates 113, 213 will become radially aligned. As can be appreciated from FIG. 4, there is arranged one guide pin 115 and guide funnel 215 at each opposite end portion of first and second alignment plates 113, 213, respectively.

Figure 6:
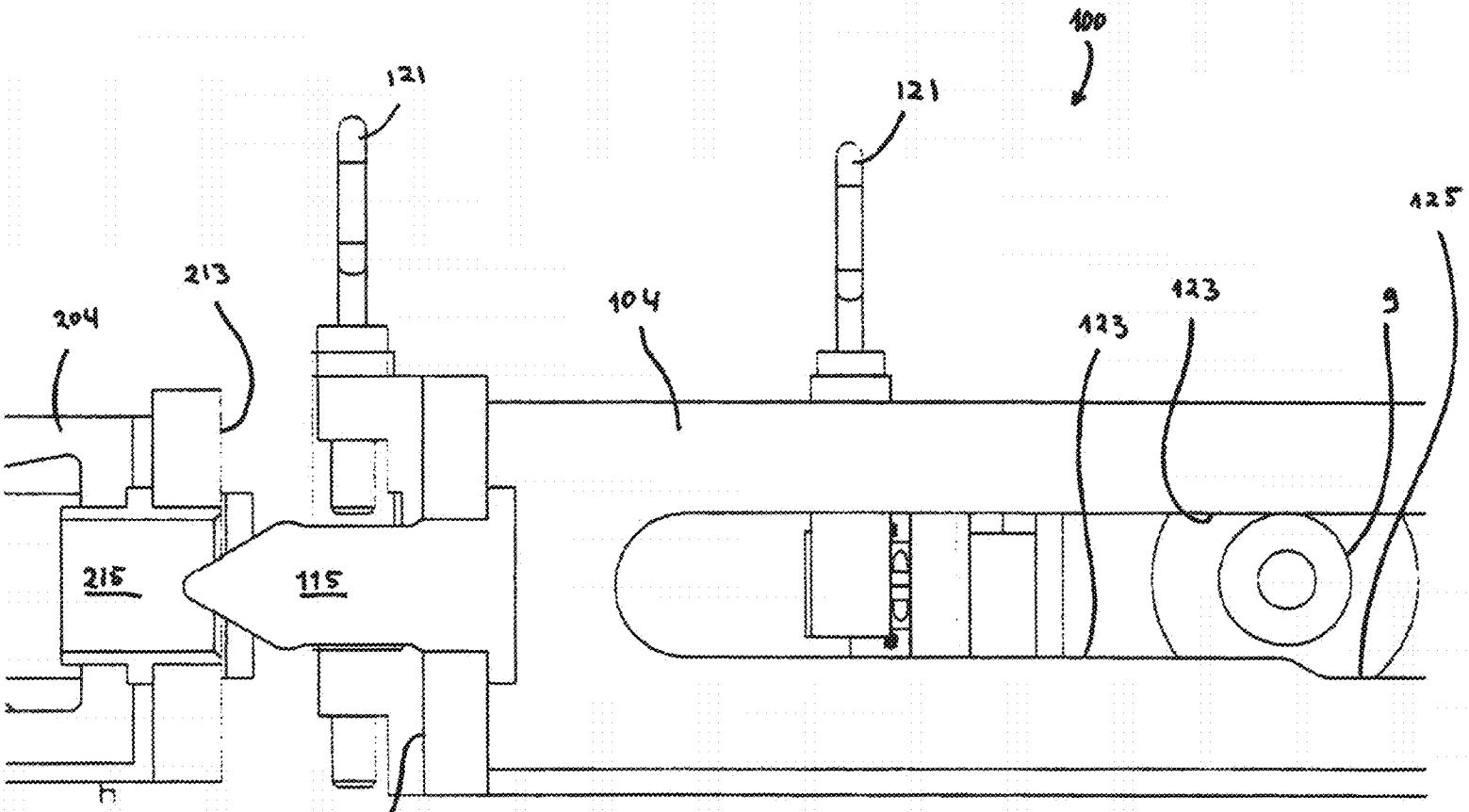
FIG. 6 is cross section side view of a part of the subsea connection assembly, during a first stage of the connection process.
Figure 7:
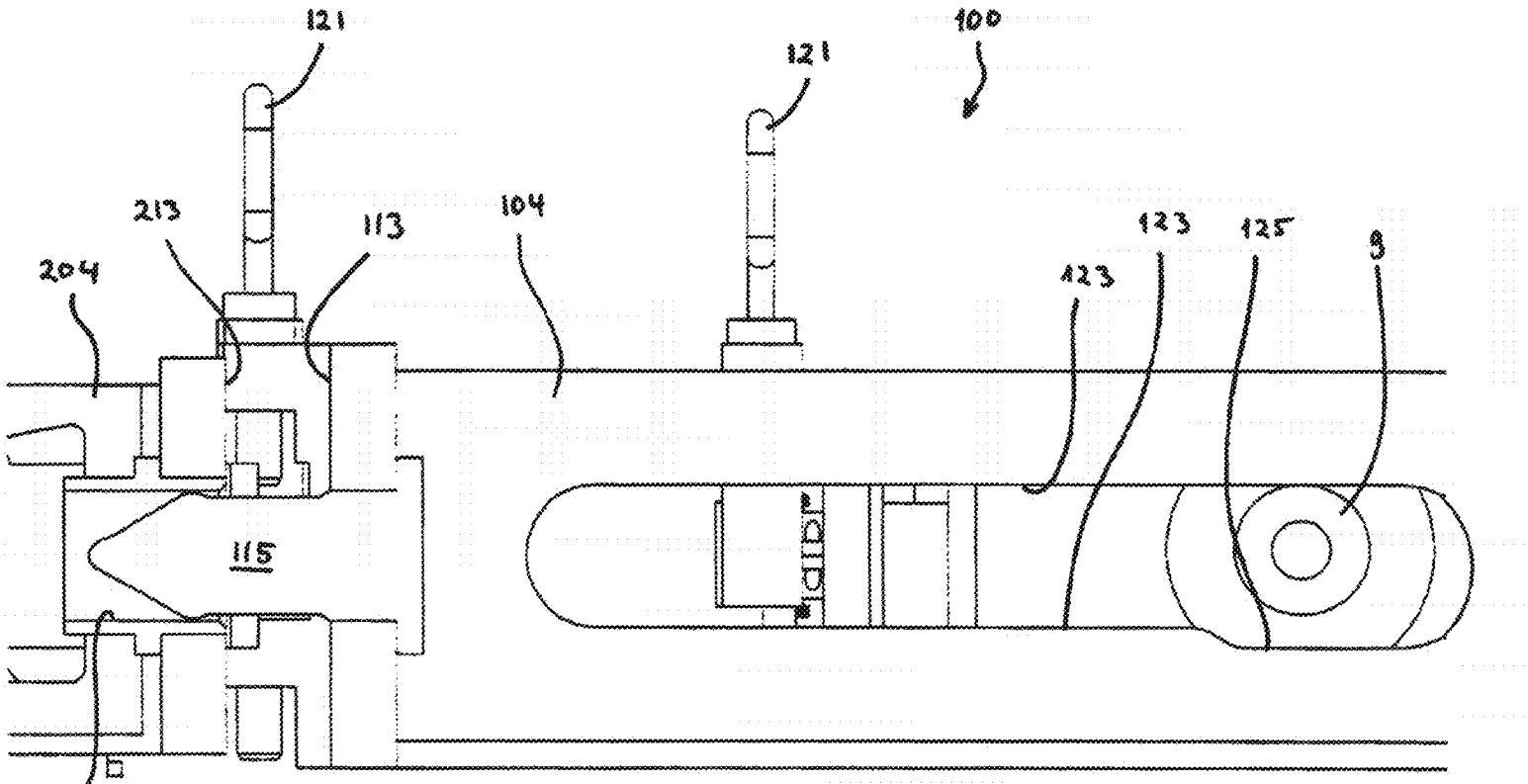
FIG. 7 is a cross section side view corresponding to FIG. 6, however illustrating the assembly somewhat later in the connection process.

The cross section views of FIG. 6 and FIG. 7 illustrate the process of inserting the guide pin 115 into the guide funnel 215. In FIG. 6, the end point of the guide pin 115 has barely entered the guide funnel 215. The guide pin 115 is illustrated in a central position in the guide funnel 215. However, the skilled person will appreciate that a radial misalignment outside this position will be aligned as the guide pin 115 is moved further into the guide funnel 215, as the tapered face of the guide pin 115 would slide along the aperture of the guide funnel 215. In FIG. 7 the guide pin 115 is shown further inserted.

FIG. 6 and FIG. 7 illustrate how the first section body 104 is movable with respect to the first module 1 in a substantially linear direction. Two guide slots 123 are arranged at two opposite sides of the first section body 104. Into each guide slot 123 there is inserted a module guide member 9. The module guide members 9 are fixed to the first module 1. Hence the module guide members 9 and the guide slots 123 are part of the mechanical interface between the first section 100 and the first module 1. Comparison of FIG. 2 and FIG. 3 discloses how the first section body 104 moves substantially linearly with respect to the first module 1.

In the situation illustrated in FIG. 6, the guide pin 115 has barely entered the guide funnel 215. The first section body 104 is resting on or is supported by two module guide members 9 in each of the two guide slots 123 (only one guide member 9 is shown in FIG. 6, while two are shown in FIG. 3). In the situation illustrated in FIG. 7, the guide pin 115 has moved still further into the guide funnel 215. In this position, the shown module guide member 9 is situated above a guide slot recess 125. Along the guide slot recess 125, the guide slot 123 exhibits a broader (taller) dimension than along the rest of the guide slot 123. As the first and second alignment plates 113, 213 are in the process of becoming aligned, as pairs of abutment faces 117, 217 (cf. FIG. 5 and description referring to FIG. 11*e* to FIG. 11*f*) abut, the guide slot recess 125 provides free vertical movement of the first section body 104 with respect to the first module 1. In other words, when the guide pin 115 is about to approach and enter the guide funnel 215, the module guide member 9 is arranged in a narrow portion of the guide slot 123. This ensures that the guide pin 115 enters within the capture range of and becomes inserted into the guide funnel 215. However, once the guide pin 115 has entered the guide funnel 215, the guide slot recess 125 ensures that the guide slot 123 does not hinder proper alignment as the movement proceeds.

Since the first section body 104 rests on the module guide members 9, one must ensure that the first section body 104 approaches the second section body 204 at a lower position than the second section body 204. Due to the shown embodiment for guiding the first section body 104 on the module guide members 9, the first section body 104 is not able to move further down, should that be necessary in order to align with the second section body 204. On the contrary, the first section body 104 is, in this embodiment, only able to move upwards, thus leaving its resting position on the module guide members 9. Indeed, when the first and second abutment faces 117, 217 abut and the first and second alignment plates 113, 213 become aligned, the first section body 104 will lift off from its resting position on the module guide members 9.

As appears from e.g. FIG. 2 and FIG. 3, two module guide members 9 are arranged on each side of the first section body 104. Thus, in this embodiment the first section body 104 comprises four guide slots 123, of which two are arranged on each opposite side.

This insertion process will be explained in more detail later, with reference to FIG. 11*a* to FIG. 11*f*.

Figure 9:
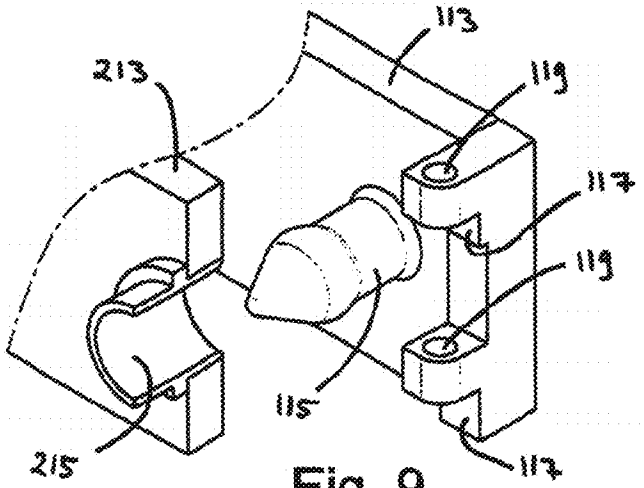
FIG. 9 is an enlarged perspective view according to FIG. 8, however with a part of one alignment plate cut away.
Figure 8:
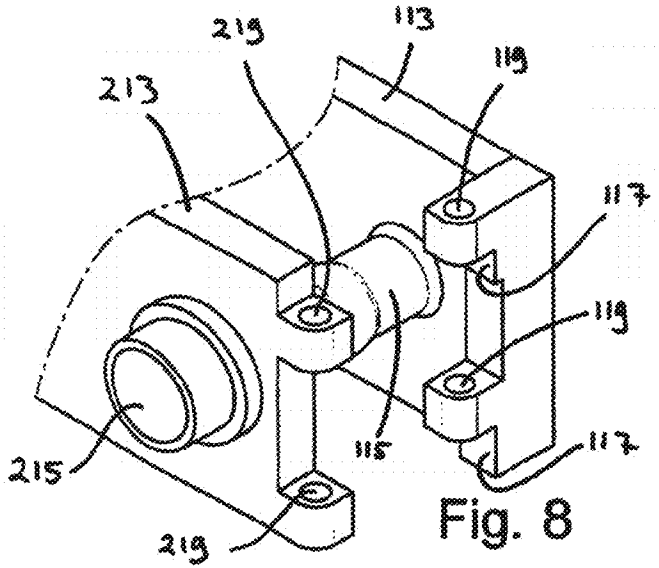
FIG. 8 is an enlarged perspective view of two alignment plates before becoming aligned.

FIG. 8 and FIG. 9 illustrate the position before the guide pin 115 has entered the guide funnel 215 with cross section views.

Figure 10:
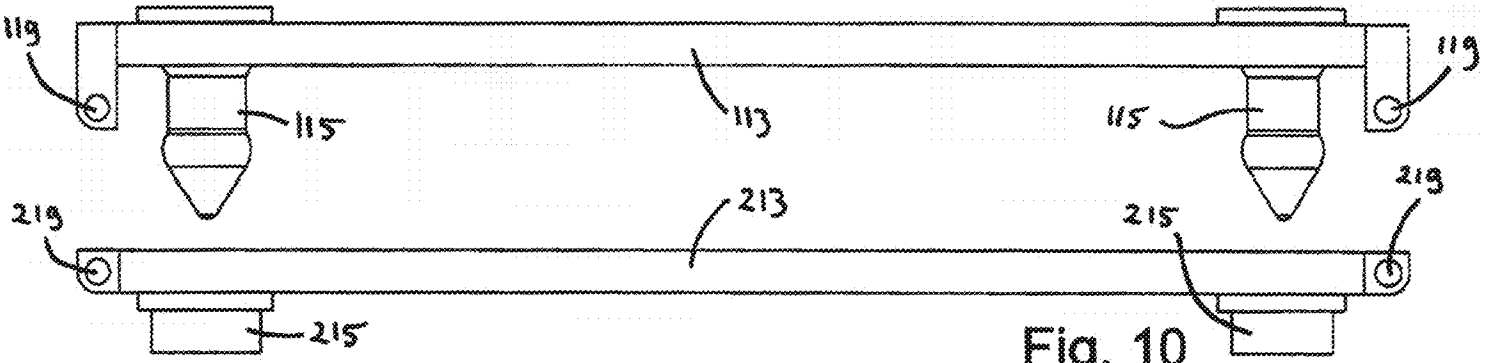
FIG. 10 is a top view of the alignment plates in FIG. 8 and FIG. 9, with some parts removed for illustrational purpose.

FIG. 10 is a top view illustrating the same situation as in FIG. 8 and FIG. 9. FIG. 10 shows that a significant distance exists between the two guide pins 115 and between the two guide funnels 215, respectively. For illustrational purpose the male connectors 111 and female connectors 211 are not shown in FIG. 10.

Referring now to FIG. 11*a* to FIG. 11*f*, the insertion of the guide pin 115 into the guide funnel 215 will be explained. Particularly, the resulting alignment between the facing alignment plates 113, 213 will be discussed.

FIG. 11*a* shows the first alignment plate 113 at a distance from the second alignment plate 213. The first alignment plate 113 is about to be moved towards the second alignment plate 213 so that the guide pins 115 will enter the facing guide funnels 215 in the second alignment plates 213. As appears from FIG. 11*a*, the guide pin 115 is arranged with some vertical misalignment with respect to the guide funnel 215. As will appear below, this vertical misalignment is made with intention. However, it is crucial that the vertical misalignment is not so large that the guide pin 115 will not enter into the guide funnel 215. That is, the guide pin 115 must be within the capture range of the guide funnel 215.

Moving on to FIG. 11*b*, the first alignment plate 113 has moved some distance towards the second alignment plate 213, and the tip of the guide pin 115 has barely entered the guide funnel 215. The guide pin 115 exhibits a tapered face 116 at its front end which, when moving still further into the guide funnel 215, will abut an end portion of the guide funnel 215 (as shown in FIG. 11*c*). As appears from FIG. 11*b*, if the first alignment plate 113 was even further vertically misaligned with respect to the second alignment plate 213 (i.e. even lower than in the shown embodiment), it could still be within the capture range.

In the situation shown in FIG. 11*c*, the tapered surface 116 of the guide pin 115 has entered into abutment with an end portion of the guide funnel 215. The continued lateral movement of the guide pin 115 into the guide funnel 215 will now result in a lift of the guide pin 115 and hence also the first alignment plate 113, as shown in FIG. 11*d*. This lift further results in a pivoting movement of the first alignment plate 113 and the first section body 104 to which the first alignment plate 113 is attached (cf. e.g. FIG. 4). The resulting misalignment angle shown in FIG. 11*d* is exaggerated for illustrational purpose.

The guide pin 115 exhibits a head portion 115*a* and a stem portion 115*b*, wherein the head portion 115*a* is arranged between the front tip of the guide pin 115 and the stem portion 115*b*. The outer diameter of the head portion 115*a* is larger than the diameter of the stem portion 115*b* and has a curved or convex shape. This feature makes the guide pin 115 able to pivot with respect to the guide funnel 215, even if the guide pin 115 is inserted in the guide funnel 215. As appears from FIG. 11*d* (and FIG. 11*e*), the position of the head portion 115*a* within the guide funnel 215 will remain constant even if the rotational angle between the guide pin 115 and the guide funnel 215 changes.

As will be appreciated by the person skilled in the art, with a prior art type guide pin and guide funnel, where a cylindrical guide pin fits snuggly into the guide funnel along a significant axial distance, such angle misalignment would not be possible without the guide pin getting stuck or jammed in the guide funnel.

In FIG. 11*e*, the guide pin 115 has been moved further into the guide funnel 215, and has the same angle with respect to the guide funnel 215 as in FIG. 11*d*. However, in the position shown in FIG. 11*e*, a first abutment face 117 of the first alignment plate has moved into abutment with a second abutment face 217 on the second alignment plate 213. As a result, the continued movement of the first alignment plate 113 towards the second alignment plate 213 will make the mutual angle between them become aligned, as shown in FIG. 11*f*. In FIG. 11*f*, the pair of first and second abutment faces 117, 217 below the guide pin 115, as well as the pair of first and second abutment faces 117, 217 above the guide pin 115, have moved into abutment with each other. In this position (FIG. 11*f*) the first and second alignment plates 113, 213 are fully aligned:

i) Since there are two pairs of engaged guide pin and guide funnel 115, 215, having a significant distance between them, the alignment plates 113, 213 are aligned with respect to an angle about an axis parallel to the direction of the guide pins 115 (cf. FIG. 10);

ii) Since the largest diameter of the guide pins 115, namely the diameter of the head portion 115*a* are arranged with appropriate tolerance within the inner diameter of the guide funnel 215, the first alignment plate 113 is both vertically and laterally aligned with the second alignment plate 213; and iii) Since there are four pairs of abutting abutment faces 117, 217 (two pairs at each lateral end of the alignment plates), the alignment plates 113, 213 are angularly aligned with respect to a plane extending transversally to the axial direction of the guide pins 115 and guide funnels 215.

Worth noting is that the two alignment plates 113, 213 are now fully aligned in every respect, despite the rather short distance of movement. This is possible due to the particular design of the guide pin 115 (head portion 115*a* and slimmer stem portion 115*b*) and the abutment faces 117, 217. Also worth noting is that the first section body 104 has been lifted up from its position shown in FIG. 11*a* to its position shown in FIG. 11*f*.

As will be appreciated by the person skilled in the art, when moving from the position shown in FIG. 11*a* to the position shown in FIG. 11*f*, one must make sure that the guide pins 115 enter within the capture range of the guide funnels 215. Thus, the mutual position between the first and second alignment plates 113, 213 must be within controlled tolerances. However, one must also ensure that the first alignment plate 113 is free to move with respect to the second alignment plate 213, so that it may become aligned. The solutions for complying with these two needs are discussed below with reference to FIG. 12*a* to FIG. 12*f*, FIG. 13 and FIG. 14.

FIG. 11*g* illustrates an alternative embodiment of a guide pin 115 and a guide funnel 215. In this embodiment, the guide pin 115 is without the guide pin head portion (115*a* in the embodiment above). Instead, the guide funnel 215 is provided with a radially inwardly protruding collar 215*a*. Along a guiding distance of the guide funnel 215, this collar 215*a* exhibits the smallest inner diameter of the guide funnel 215. As with the embodiment shown in FIGS. 11*a* to 11*f*, the embodiment shown in FIG. 11*g* also features the possibility of an angle between the guide pin 115 and guide funnel 215 without the guide pin 115 getting stuck. When the guide pin 115 is inserted into the guide funnel 215, in the embodiment depicted in FIG. 11*g*, the front portion of the guide pin 115 slides a distance past the protruding collar 215*a* of the guide funnel 215.

The situations shown in FIG. 12*a* to FIG. 12*f* correspond to the situations shown in FIG. 11*a* to FIG. 11*f*, respectively. The first section body 104 comprises two plates that are attached to the first alignment plate 113 and which extend perpendicularly backwards from the first alignment plate 113 (see also FIG. 13). One such plate of the first section body 104 is shown in the side views of FIG. 12*a* to FIG. 12*f*. The plate has two guide slots 123. In each guide slot there is a guide slot recess 125, which provides sufficient freedom of vertical movement for the first section body 104 as it is lifted up from its resting position on the module guide members 9. This process was discussed above with reference to FIG. 6 and FIG. 7, as well as with reference to FIG. 11*a* to FIG. 11*f*.

In an alternative embodiment, one could imagine the guide slot 123 being without a lower part. I.e. the first section body 104 could rest on the upper rim of the guide slot 123 before moving it towards the second alignment plate 213 (as in the shown embodiment), and could be without a lower rim (i.e. it could be entirely open in the downwards direction). Such a solution would, however, be limited horizontally arranged embodiments, where the first section body 104 moves substantially in a horizontal direction/movement path. With the guide slot 123 described with reference to the drawings, including the guide slot recess 125, the assembly could have an arbitrary orientation, even upside down, and still function as intended.

While the guide slots 123 and their guide slot recesses 125 ensures freedom of movement in the vertical direction for the first section body 104, the first section body 104 also needs freedom of movement in the lateral direction. FIG. 13 is a top view of some of the parts of the first section body 104 (the first alignment plate 113 and the two plates of the first section body 104 extending perpendicularly backwards from the first alignment plate 113). Several parts of the first section body 104 are omitted in this view for illustrational purpose.

As discussed above, the module guide members 9 are fixed to the first module 1, and they extend through the guide slots 123 with a guide portion 9*a*. The guide portion 9*a* is shaped like a short cylinder. At the end of the guide portion 9*a*, the guide members 9 have an end flange 9*b* that extend beyond the vertical extension of the guide slots 123. Thus, the plates of the first section body 104 may move some lateral distance along the guide portion 9*a* of the guide member 9. This movement is however limited by the end flange 9*b* and a portion of the first module 1. FIG. 14 is an enlarged view of a portion of FIG. 13, illustrating the interface between the guide member 9 and a plate of the first section body 104 in better detail.

As discussed with reference to FIGS. 11*a* to 11*f*, when moving the first section body 104, to which the first alignment plate 113 belongs, towards the second alignment plate 213, one must ensure that the guide pins 115 enter within the capture range of the guide funnels 215. Once they have entered, however, there must be freedom of movement so that alignment may take place. In order to meet these requirements in the lateral direction, the plates of the first section body 104 are equipped with freedom limitation plates 106 that coincide with the end flanges 9*b* of the guide members 9 in the position before the guide pins 115 have entered the guide funnels 215. As appears from FIG. 13 and FIG. 14, the freedom limitation plates 106 limit the lateral movement of the first section body 104 when the first section body 104 starts to move toward the second alignment plate 213. After some movement, however, the freedom limitation plates 106 will move out of their overlapping position with the end flanges 9*b* of the guide members 9. The plates of the first section body 104 will then be able to move freely in the lateral direction along the guide portion 9*a* of the guide members 9. This ensures lateral freedom of movement as the first alignment plate 113 (which is part of the first section body 104) aligns with the second alignment plate 213.

When the first section body 104 shall be retracted, i.e. be moved away from the second alignment plate 213, inclined faces 106*a* on the freedom limitation plates 106 will abut the end flanges 9*b* and move the first section body laterally into the initial retracted position.

The end flange could also be on opposite side of the shown embodiments, i.e. a portion of the module could be interpreted as the end flange.

Reverting to FIG. 5, the first alignment plate 113 comprises four first abutment faces 117. Directly opposite of the four first abutment faces 117, four second abutment faces 217 are arranged on the second alignment plate 213. When the stroke tool 400 (FIG. 3) pulls the first and second alignment plates 113, 213 towards each other, the four first abutment faces 117 will eventually abut against the second abutment faces 217 and thereby stop the mutual movement of the alignment plates 113, 213. If a misalignment angle exists between the two alignment plates 113, 213, with respect to their respective axis perpendicular to their front faces, this abutment will ensure alignment. Moreover, as discussed above, the two guide pins 115 that enters the two guide funnels 215 ensure that the two alignment plates 113, 213 are mutually aligned along a plane parallel to their front faces (i.e. rotationally aligned about an axis perpendicular to their front faces).

Instead of having four abutment faces on each alignment plate, one can also imagine having more or less.

Still referring to FIG. 5, close to the first and second abutment faces 117, 217 are latching arrangements in the form of first latching bores 119 on the first alignment plate 113 and second latching bores 219 on the second alignment plate 213. The center axis of the first and second latching bores 119, 219 will be aligned when the two alignment plates 120 113, 213 have been aligned with each other (abutting). In order to retain them in the aligned position, latch pins 121 are inserted into the first and second latching bores 119, 219. This can be performed by means of a remotely operated vehicle (ROV). FIG. 2 and FIG. 4 show the latch pins 121 in a non-latched position, while FIG. 3 shows the latch pins 121 in a latched position, i.e. inserted through both the first and second latching bores 119, 219.

Advantageously, the latching arrangements 119, 219 are arranged at the end portions of the first and second alignment plates 113, 213. Moreover, the latching arrangements 119, 219 are arranged in immediate proximity to the first and second abutment faces 117, 217. This contributes in maintaining a best possible alignment once the latching arrangements have been latched, i.e. once the latch pins 121 have been inserted into the first and second latching bores 119, 219, and (the force of) the stroke tool 400 (FIG. 3) has been removed.

FIG. 15 is an enlarged perspective view showing a portion of the first alignment plate 113 of the first section 100 and a cross section of a portion of the second section 200. Supported in first section 100 is the male connector 111. The male connector 111 is adapted to engage the female connector 211 which is supported in the second section 200.

FIG. 16 shows the same situation as in FIG. 15, however with a cross section side view. The alignment plates 113, 213 have been moved into close proximity with each other and have thus been roughly aligned.

FIG. 17 is an enlarged portion of some of the components shown in FIG. 16. The male connector 111 exhibits a protruding portion 127. The female connector 211 exhibits a receiving portion 227 which is adapted to receive the protruding portion 127 as the alignment plates 113, 213 move towards each other to their aligned end position. Thus, when the alignment plates 113, 213 have been moved towards each other and fully aligned (corresponding to FIG. 11*f* and FIG. 12*f*), the protruding portion 127 of the male connector has been inserted into the receiving portion 227 of the female connector 211. It should be noted that at this point, an electric connection between the male and female connector 111, 211 has still not been established.

Still referring to FIG. 17, the protruding portion 127 of the male connector 111 comprises a tapered face 129 at its foremost end and a cylindrical face 131 adjacent to the tapered face 129. Correspondingly, the receiving portion 227 has an inwardly facing tapered face 229 and an inwardly facing cylindrical face 231. Similar to the head portion 115*a* of the guide pin 115, the protruding portion 127 of the male connector 111 also has a head 130 in the embodiment shown in FIG. 17 (contrary to the embodiment shown in FIG. 15 and FIG. 16). The head 130 exhibits a larger diameter than the cylindrical face 131 has. As a result, some angular misalignment may exist between the male and female connectors 111, 211 without the protruding portion 127 getting stuck in the receiving portion.

As the protruding portion 127 engages the receiving portion 227, the tapered faces 129, 229 will engage and contribute to an additional and more precise alignment than the mutual alignment of the alignment plates 113, 213. Eventually, the head 130 of the male connector 111 will be inserted within the cylindrical face 231 of the female connector 211. Here, the tolerances can be quite narrow, so that a quite precise alignment may be obtained. When the stroke tool 400 has moved the alignment plates 113, 213 towards each other to maximum extent, the protruding portion 127 has entered the receiving portion 227. FIG. 18 depicts this situation in a perspective cross section view, showing only the parts of the male connector 111 and the female connector 211. In this position, a first movement have aligned the facing connectors 111, 211 with each other. However, no electrical connection has yet been made between them.

Preferably, the end faces of the male and female connectors 111, 211, i.e. their faces that face in the axial direction, towards the opposite connector, should abut each other when the alignment plates 113, 213 have been fully moved and aligned. In this manner most of the water between these faces will be forced away (and thus not become moved into the female connector 211 when the male connector 111 is inserted, as described further below).

The same situation as in FIG. 18 is shown with the perspective view of FIG. 19, wherein some parts are removed for illustrational purpose.

Above, a first movement has been described, wherein the entire first section body 104 was moved with respect to the first module 1 and towards the second module 2. With this movement, the first alignment plate 113 was moved towards and against the second alignment plate 213. The male connectors 111 was aligned and with the female connectors 211, however no connection was made. A second movement, wherein the male connectors 111 are moved into the female connectors 211 will be described later. In this second movement, the first section body 104 is not moved, however the male connectors 111 are moved with respect to the first section body 104.

In the following will be described how the first alignment plate 113, male connectors 111, the cables/lines 107, bend restrictor 101 and the stroke tool interfaces 103, 105 are mechanically and mutually connected in the first section body 104.

FIG. 20 and FIG. 21 are a side view and a top view of the first and second sections 100, 200. In the shown position, the first section body 104 has been moved into engagement with the second section body 204. Thus, the first and second alignment plates 113, 213 are aligned. As will be appreciated by the person skilled in the art, although the embodiments described herein are shown with a first section body 104 moving in the horizontal direction, the first and second sections 100, 200 could also be arranged perpendicularly to the shown embodiments. That is, the first and second sections 100, 200 could be arranged in a vertical fashion, wherein the movement of the first section body 104 would be in a vertical direction. In some cases, one could also arrange them in an inclined orientation, if that is considered appropriate.

FIG. 22 and FIG. 23 are top views of the first section 100 connected to the second alignment plate 213 and the female connectors 211. For illustrational purpose, several components are removed. In both drawings, the first movement, namely the movement of the first section body 104 towards the second alignment plate 213 (and hence the second section body 204, cf. FIG. 4) has already been performed. However, while the second movement has been performed in the situation shown in FIG. 23, the second movement has not yet been performed in the situation shown in FIG. 22. The second movement involves moving the male connectors 111 into the female connectors 211 in order to establish a connection (an electric high voltage connection in this embodiment).

When moving the male connectors 111 into the female connectors 211, a part of them moves through the first alignment plate 113. In order to transmit the necessary force to the male connectors 111 for this movement, they are attached to a reaction plate 114. The second stroke tool interface 105 (cf. FIG. 2) connects to the reaction plate 114 so that the stroke tool 400 can provide the necessary movement force. As stated above, other means for providing such movement are also possible. For instance permanently installed electric or hydraulic actuators may be installed to provide both the first and the second movement, back and forth.

Similarly to the first and second alignment plates 113, 213, the reaction plate 114 is also provided with a latching arrangement, such as latching bores 119, by means of which the reaction plate 114 can be latched in a connected position with latching pins 121 (i.e. the position shown in FIG. 23). The latching bores 119 will then coincide with latching bores in latching flanges 120 fixed to the first alignment plate 113 (cf. FIG. 4 and FIG. 5).

Also attached to the reaction plate 114 are the penetrators 109. At the opposite side of the penetrators 109, i.e. opposite with respect to the reaction plate 114, each line 107 comprises a flexible part 110.

The flexible part 110 of each line 107 extends into a cable support assembly 90. The cable support assembly 90 is provided with a front support plate 91, a back support plate 93 (cf. FIG. 24), a lower support plate 97 and three support tubes 95 that extend between the front and back support plates 91, 93. The entire cable support assembly 90 preferably constitutes a rigid, non-flexible assembly. FIG. 24 depicts the same components as shown in FIG. 22 and FIG. 23, however with a perspective view. The back support plate 93 connects to the bend restrictor 101, through which the lines 107 extend.

The cable support assembly 90 retains the lines 107/cables firmly in such manner that they will not slide slip.

As is perhaps most clear from the perspective view of FIG. 25, the front support plate 91, back support plate 93, and the support tubes 95 are split along a plane which coincides with the lines 107, so that the lines can be arranged inside the cable support assembly 90. The upper and lower parts can be fixed for instance by with bolts (not shown).

FIG. 25 shows the bend restrictor 101, the cable support assembly 90, and the reaction plate 114 without the lines 107 for illustrational purpose. The reaction plate 114 is firmly fixed to a connection plate 112. Furthermore, the connection plate 112 attaches to the lower support plate 97 of the cable support assembly 90 with a loose connection. That is, a pull in the connection plate 112, as a result of movement of the reaction plate 114, will result in a pull in the lower support plate 97 and hence in the cable support assembly 90. However, the connection between the connection plate 112 and the lower support plate 97 is not able to transmit a bending force/torque. In this manner, no bending force is transmitted to the male connectors 111. Any bending force from the lines 107 that extend through the bend restrictor 101 will be transmitted to the cable support assembly 90. FIG. 26 shows the same components as shown in FIG. 25, from another angle.

FIG. 26*a* illustrates how the connection plate 112 can be connected to the lower support plate 97 by mans of bolts of one plate extending through slits in the other plate.

The cable support assembly 90 is supported in the main section body 104 by means of engagement with two sliding lists 98. The sliding lists 98 are fixed to the first section body 104 (see e.g. FIG. 19 and FIG. 22). Thus, when performing the above discussed second movement, by means of which the male connectors 111 enter the female connectors 211 by moving the reaction plate 214, the cable support assembly 90 will follow by sliding in the two sliding lists 98, thus moving with respect to the first section body 104.

FIG. 27 and FIG. 28 are enlarged perspective views of the two alignment plates 113, 213, the reaction plate 114, and the male and female connectors 111, 211, with some portions cut away for illustrational purpose. In the situation shown both in FIG. 27 and in FIG. 28, the alignment plates 113, 213 have been aligned, but the male connectors 111 have not yet been moved into the female connectors 211.

The discussion above relates to how the first alignment plate 113 and the second alignment plate 213 have become mutually aligned. This alignment has been provided by the guide pins 115 entering the facing guide funnels 215, as well as the first abutment faces 117 abutting the second abutment faces 217. This first stage of alignment was brought about by moving the first section body 104 towards the second section body 204 by means of the stroke tool 400. The male and female connector 111, 211 were aligned with respect to each other in this manner. By moving the reaction plate 114, the electric high voltage connection is provided by inserting the male connector 111 into the female connector 211. The male connector 111 and the female connector 211 will now be described.

FIG. 29 is a cross section perspective view of the male connector 111 and the female connector 211, which represents embodiments of an aspect of the present invention. In the situation shown in FIG. 29, a contact pin 141 of the male connector 111 has been inserted into a contact bore 241 of the female connector 211. This insertion can be performed with the stroke tool 400 (FIG. 3) discussed above, as will be described later. Also as discussed above, in this embodiment, electrical high voltage connectors are described.

The contact pin 141 has a cylindrical shape with a concentric cross section. A part of the contact pin 141 which enters into the contact bore 241 of the female connector 211 comprises a contact face 145 which faces in a radial direction. The contact face 145 is a face of a pin conductor 143 in the contact pin 141 which is of an electrically conducting material, such as copper. At the front portion of the contact pin 141 there is arranged a male isolating isolation head 147. The male isolation head 147 constitutes the front face of the contact pin 141. It also constitutes the radially facing face of the contact pin 141 along a distance between the front face and the contact face 145 of the pin conductor 143. At the opposite side of the contact face 145, the contact pin 141 comprises an isolating sleeve 149. The isolating sleeve 149 is of an electrically isolating material, for instance the same material as the male isolation head 147.

Along an axial portion of the contact bore 241 of the female connector 211, a bore conductor 243 exhibits an inwardly facing face. When the contact pin 141 is inserted into the contact bore 241, as shown in FIG. 29, the contact face 145 of the pin conductor 143 is electrically connected to the bore conductor 243. Outside of the bore conductor 243 there is an electrically isolating protection sleeve 257.

To illustrate the cooperative function of the male connector 111 and the female connector 211, reference is now also made to FIG. 30. FIG. 30 shows the same components as FIG. 29, however in a position where the contact pin 141 has not been inserted into (or has been retracted from) the contact bore 241 of the female connector 211. This position corresponds the position shown in and described with reference to FIG. 18 and FIG. 19.

In the non-contact position, shown in FIG. 30, the contact face 145 of the pin conductor 143 abuts a facing protection sleeve 157. The protection sleeve 157 is of an isolating material and fits snuggly about the contact face 145 in order to protect the latter from possible damaging components. Hence, when in this position the entire pin conductor 143 is well protected within the said protection sleeve 157, male isolation head 147 and the isolating sleeve 149.

Thus, in the non-contact position (FIG. 30), the electric conductor in the male connection 111 (i.e. the contact pin 143) is protected from the environment, typically seawater. As a result, one does not need to protect the connector with a protection cap.

In order to move the contact pin 141 back and forth, a rear end of the contact pin 141 is attached to a contact operation slide 151. The contact operation slide 151 has a contact operation flange 153 which again connects directly or indirectly to an actuator. In the embodiment described above, the contact operation flange 153 is fixed to the reaction plate 114, which is moved by means of the stroke tool 400, via the second stroke tool interface 105. The second stroke tool interface 105 appears in FIG. 2 and FIG. 4. By arranging the stroke tool 400 in engagement with the second stroke tool interface 105, the contact operation slide 151 can be moved axially on a male connector main body 155 in a sliding manner. As will be appreciated by the person skilled in the art, any appropriate type of actuator, permanently or temporarily installed, may be chosen to provide movement of the contact operation slide 151. The male connector main body 155 has cylindrical and concentric outer face portion on which the contact operation slide 151 reciprocates.

The pin conductor 143 is connected to the conductor in the line 107 (FIG. 4) in a manner known to the person skilled in the art, typically via a penetrator.

Still referring to FIG. 30, when in the non-contact position, a distance sleeve 159 has a distance from the protection sleeve 157. In this position, a first liquid chamber 161 is confined by the isolating sleeve 149, the male connector main body 155, the protection sleeve 157 and the distance sleeve 159. At its opposite end, the distance sleeve 159 abuts an end portion 152 of the contact operation slide 151. Thus, when the contact operation slide 151 is moved towards the connected position (FIG. 29), the volume of the first liquid chamber 161 reduces to substantially zero. To account for this reduction, the liquid is received in a second liquid chamber 163, the volume of which increases during said movement.

The second liquid chamber 163 is radially confined between the male connector main body 155 and the contact operation slide 151, and thus has the shape of a sleeve. At one axial end of the second liquid chamber 163 it is confined by a flange portion 154 of the contact operation slide 151. The flange portion 154 is provided with seals that seal against the outer surface of the male connector main body 155. At the opposite end, the second liquid chamber 163 is confined by an annular piston 165. The annular piston 165 is arranged between the outer surface of the distance sleeve 159 and the inner surface of the contact operation slide 151. Moreover, it is provided with seals on its radially inner and outer surfaces, which seal against the distance sleeve 159 and the contact operation slide 151. Upon a pressure difference over the annular piston 165, the resulting force will move it towards the low pressure side. Thus, as can be appreciated by comparing FIG. 29 and FIG. 30, as the volume of the first liquid chamber 161 is reduced and the liquid inside it flows into the second liquid chamber 163 (moving from position in FIG. 30 to position in FIG. 29), the annular piston 165 moves towards the end portion 152 of the contact operation slide 151. This movement of the annular piston 165 increases the volume of the second liquid chamber 163. When the contact pin 141 is pulled out of engagement with the contact bore 241, liquid in the second liquid chamber 163 flows back into the first liquid chamber 161 (moving from position in FIG. 29 to position in FIG. 30).

The liquid in the first and second liquid chambers 161, 163 is preferably a liquid suitable for long lasting protection of the contact pin 141, such as an oil.

Through the wall of the contact operation slide 151 there are arranged apertures (not visible in the drawings), through which a third liquid chamber 167 is in fluid communication with the ambience. The apertures are covered with a clamp 169 which is provided with a sieve. In this way, the interior pressure of the contact operation slide 151 is balanced with respect to exterior pressure.

On one axial end, the third liquid chamber 167 is confined by the annular piston 165. On its opposite end, the third liquid chamber 167 is confined by an end piston 171. The end piston 171 is arranged between the third liquid chamber 167 and an end chamber 168. The end chamber 168 is in fluid connection with the second liquid chamber 163. Moreover, a biasing spring 170 is arranged between the distance sleeve 159 and a shoulder of the end piston 171, so as to provide an overpressure in the first liquid chamber 161, second liquid chamber 163 and end liquid chamber 168, compared to the ambient pressure and the corresponding pressure in the third liquid chamber 167.

Still referring to FIG. 29 and FIG. 30, the function of the female connector 211 will now be described. FIG. 30 illustrates the non-connected mode. The protruding portion 127 of the male connector 111 protrudes into the receiving portion 227 of the female connector 211. A front face of the male isolation head 147 of the male connector 111 faces a corresponding front face of a female isolation head 247 of the female connector 211.

Extending about the front face of the male isolation head 147 of the male connector 111 is a male connector forward face 148. Correspondingly, extending about the female isolation head 247 is a female connector forward face 248 (cf. FIG. 18).

The female isolation head 247 has the shape of a sleeve with an inner bore, thus having a head portion and a sleeve portion 233. Within the bore of the sleeve portion 233 of the female isolation head 247, there is arranged a spring guiding sleeve 248. The female isolation head 247 and the spring guiding sleeve 248 are adapted to reciprocate with respect to each other in a telescopic fashion. Moreover, within the female isolation head 247 and the spring guiding sleeve 248 there is arranged a coil spring 250.

When the contact pin 141 of the male connector 111 is inserted into the contact bore 241 of the female connector 211, the coil spring 250 provides some resistance and is compressed, as shown in FIG. 29. In this compressed state, the coil spring 250 is compressed between a front part of the female isolation head 247 and an end conductor 256. The end conductor 256 is electrically connected to the bore conductor 243 and leads to the rear portion of the female conductor 211. Similar to the male connector, the end conductor 256 is arranged within an isolating sleeve 249 of an electrically isolating material.

Since the front faces of the two abutting isolation heads 147, 247 are parallel and substantially covers the area within the inner diameter of the contact bore 241, most seawater will be forced away when the isolation heads 147, 247 abut against each other.

As shown in FIG. 30, the female connector main body 255 and the male connector main body 155 are provided with seals 144, 244 which seals against the isolation heads 147, 247 of the male and female connector 111, 211, respectively. The seals 244 on the female connector 211 prevent surrounding fluid, typically seawater, to enter the contact bore 241. Also arranged, surrounding the contact pin 141 and the female isolation head 247 are scrapers 146, 246, which upon movement of the contact pin 141 and female isolation head 247, scrape off possible fragments. One should also note that the protruding portion 127 of the male connector 111 snugly fits within the receiving portion 227 of the female connector, thereby displacing as much fluid (seawater) as possible before the contact pin 141 is inserted.

Similar to the male connector 111, the female connector 211 also exhibits a first liquid chamber 261, which is in the same compartment as the coil spring 250. As the contact pin 141 moves into the contact bore 241 of the female connector 211, the volume of the first liquid chamber 261 is reduced. A portion of the liquid will then flow into a second liquid chamber 263, corresponding to the function of the male connector 111. In the female connector 211, the second liquid chamber 263 is situated between a chamber flange 258 and an annular piston 265. A fluid path exists between the first and second liquid chambers 261, 263, through the chamber flange 258. As with the annular piston 165 of the male connector 111, the annular piston 265 of the female connector 211 is adapted to move axially within a female connector main body 255, as liquid moves between the first and second liquid chambers 261, 263. The annular piston 265 is provided with seals that seal against an inner surface of the female connector main body 255. The annular piston 265 is further equipped with a sleeve section 266 that extends rearwards towards an end piston 271. An outer face of the sleeve section 266 abuts a seal on the inner face of the end piston 271 of the female connector 211.

Between the sleeve section 266 and the inner face of the female connector main body 255 a third liquid chamber 267 exists. As with the third liquid chamber 167 of the male connector 111, this third liquid chamber 267 is also pressure balanced by means of apertures which are covered with a clamp 269 that is provided with a sieve.

Corresponding to the male connector 111, the female connector 211 has a biasing spring 270 which exerts a force onto the annular piston 265, thereby providing an overpressure within the first liquid chamber 261 and the second liquid chamber 263. This biasing spring 270 is compressed between the end piston 271 and a shoulder on the annular piston 265.

The male and female connector 111, 211 comprise a male connector attachment flange 135 and a female connector attachment flange 235, which are used to connect the connectors 111, 211 to the first section body 104 and the second section body 204, respectively. FIG. 5 illustrates how the female connector attachment flanges 235 are bolted to the second alignment plate 213.

FIG. 31 shows an enlarged cross section perspective view of the female connector 211, corresponding to the female connector shown in FIG. 30. The female connector attachment flange 235 is part of or fixed to an attachment body 236. The attachment body 236 has the shape of a cylindrical sleeve. Within the bore of the attachment body 236 the female connector main body 255 is arranged. As can be appreciated from FIG. 31, along an axial distance between the attachment body 236 and female connector main body 255 there is arranged a flexible support body 238. The flexible support body 238 supports the female connector main body 255 within the attachment body 236. It is arranged between an outwardly facing cylindrical surface 281 of the female connector main body 255 and an inwardly facing cylindrical surface 283 of the attachment body 236. In the supported position, the female connector main body 255 is positioned with a radial distance from the attachment body 236. However, the flexible support body 238 is adapted to yield for radially directed forces between the female connector main body 255 and the attachment body 236. Thus, if a misalignment exists when the protruding portion 127 (FIG. 17) of the male connector 111 enters the receiving portion 227 of the female connector 211, the female connector main body 255 will adapt or align itself to the position of the male connector 111. That is, as the tapered face 129 of the protruding portion 127 exerts a force on the tapered face 229 of the receiving portion, the female connector main body 255 will yield and thereby move slightly in the radial direction (cf. FIG. 17) and possibly also in a pivoting direction (about an axis transverse to the axial direction).

In the embodiment shown in FIG. 31, the flexible support body 238 is made of a corrugated flexible material which will allow the said radial movement. Possible embodiments include other shapes. Suitable materials can be e.g. a soft rubber.

In addition to the flexible support body 238, at each axial end of the attachment body 236 there are arranged flexible rings 240. The flexible rings 240 are made of a flexible material and allow some mutual axial movement between the female connector main body 255 and the attachment body 236. In addition they need to allow for said radial or pivoting movement discussed above. A possible material in the flexible rings 240 is a soft rubber.

In order to retain the attachment body 236 in the axial position on the female connector main body 255, as well as making it possible to mount the attachment body 236, an attachment clamp 242 is secured to the female connector main body 255. In this embodiment, one of the flexible rings 240 is arranged between the attachment clamp 242 and the attachment body 236.

Reverting to FIG. 29 and FIG. 30, the skilled person will appreciate that the combination of the male connector 111 and the female connector 211 described above can be used to engage and disengage an electric connection in a subsea environment. In the non-connected mode shown in FIG. 30, the pin conductor 143 is surrounded by isolating material (male isolation head 147, protection sleeve 157, and isolating sleeve 149). The conductors in the female connector 211, namely the bore conductor 243 and the end conductor 256, are likewise surrounded by isolating materials.

Due to the isolation of the conductors, full voltage can be applied in the disconnected (non-mated) mode, even without use of isolation caps. Moreover, this makes test of earth fault possible without having to re-align the connectors 111, 211 after the test.

In a typical embodiment, a plurality of connection assemblies may be arranged to control the routing of electric power to consumers.

In an embodiment alternative to the one described above, one could imagine that the male connector 111 was attached to the first section body 104 via a flexible support body either instead of or in addition to the flexible support of the female connector main body 255. Also feasible and within the scope of the invention would be to arrange the female connector as a part of the first section 100 and thus to the first section body 104, which is moved with the stroke tool 400 towards the second section 200 (cf. FIG. 3).

In the embodiment described above, the subsea connection assembly 10 is adapted to connect three electric high voltage connectors in a subsea environment. Within the scope of the invention are also embodiments comprising less or more than three connectors. Indeed, two facing alignment plates, such as the described alignment plates 113, 213 can comprise a plurality of various high voltage connectors which may be connected simultaneously with the stroke tool 400 or any other appropriate actuator. One can also imagine a plurality of actuators which independently are able to connect and disconnect independent high voltage connectors. Thus, connected to the same alignment plate, there may be two sets of three high voltage connectors, wherein each set can be controlled independently by the operator.

In yet an alternative embodiment, the penetrators 109 on the first section 100 and/or the penetrators 209 of the second section could exhibit an angle, typically 90 degrees. In such embodiments, the bend restrictor 101 could at its position of engagement with the first section body 104 extend perpendicularly with respect to the longitudinal extension of the connectors 111, 211. In other words, the bend restrictor 101 could, at its point of engagement with the first section 100/first section body 104, extend substantially perpendicular to the direction of movement when moving the first section body 104 towards or away from the second alignment plate. Such a solution may limit the necessary space needed behind the first section body 104. The solution may also reduce the force needed for moving the first section body 104 and the connectors (preferably the male connectors 111). Such an embodiment is depicted in FIG. 32, in which the penetrators are barely visible. Compared to the embodiment described above, the cable support assembly 90 is oriented 90 degrees, connecting the depending lines 107 to the connection assembly 10.

As mentioned above, instead of the stroke tool one can also employ other types of actuators for moving and aligning the alignment plates, as well as for moving the male connectors into engagement with the female connectors. In one embodiment, one may for instance use one hydraulic actuator to move and align the two facing alignment plates, while two electric actuators may independently move respective sets of electric high voltage connectors. In this manner, the operator is able to separately choose which connections to make and is thereby able to remotely route high voltage power supply.

As will be appreciated by the person skilled in the art, the subsea connection assembly according to the invention does not need to be attached to large subsea modules as described with reference to FIG. 1. Rather, the assembly can be used for instance in association with a subsea well template, a manifold or any other subsea structure with which the operator needs to connect and/or disconnect any type of transmission lines by using wet-mate connectors.

Although the embodiments described herein are related to solutions including two movements, i.e. a first movement moving the first section body and a second movement moving the male connectors, it should be appreciated that other solutions could involve only the first movement. I.e. embodiments may include moving the first section body and its first alignment plate towards and away from the second section body and its second alignment plate. It should also be understood that the high voltage wet-mate connectors, as particularly described with reference to FIG. 29, FIG. 30 and FIG. 31, may be used in other contexts or technical solutions than shown herein.

The invention claimed is:

1. A subsea high voltage connection assembly comprising a first section having a first section body to which a set of first connector(s) is arranged and a second section having second section body to which a set of second connector(s) is arranged, wherein the subsea connection assembly further comprises a section body movement arrangement adapted to move one of the section bodies towards and away from the other section body, between a disengaged position and an engaged position, wherein the subsea connection assembly further comprises a connector movement arrangement;

wherein the first section body comprises a first alignment plate and the second section body comprises an oppositely arranged second alignment plate, one of which comprises a guide pin and the other of which comprises a facing guide funnel;

wherein at least one of the guide pin and the guide funnel exhibits a tapered face; and wherein the guide pin comprises a head portion at its front end and a stem portion between the head portion and its base, wherein the head portion exhibits a larger diameter than the stem portion.

2. The subsea high voltage connection assembly according to claim 1, wherein, when in the engaged position, the set of first connector(s) and the set of second connector(s) are interchangeable between a disconnected mode and a connected mode.

3. A subsea high voltage wet mate connector assembly comprising a male connector having a male connector main body and a female connector having a female connector main body, the male and female connectors are adapted to be joined into an engaged position and separated out to a disengaged position, in which engaged position the male connector is aligned with the female connector and the male connector main body and the female connector main body remain in a constant mutual position, wherein, when in said engaged position, a contact pin of the male connector is adapted to move between a connected position, in which it is inserted into a contact bore of the female connector, and a disconnected position, in which it is retracted into the male connector; and wherein the male connector and/or the female connector comprise(s) a first liquid chamber and a second liquid chamber between which a liquid communication exists, wherein the second liquid chamber is adapted to receive a protective liquid from the first liquid chamber upon movement of the contact pin from the disconnected position to the connected position.

4. The subsea high voltage wet mate connector assembly according to claim 3, wherein an annular piston constitutes a movable confinement of the second liquid chamber and is arranged between a third liquid chamber and the second liquid chamber, wherein the third liquid chamber is in liquid communication with the exterior of the male and/or female connector.

5. The subsea high voltage connection assembly according to claim 1, wherein the head portion at its outer diameter has a convex shape.

6. A subsea high voltage connection assembly comprising a first section having a first section body to which a set of first connector(s) is arranged and a second section having second section body to which a set of second connector(s) is arranged, wherein the subsea connection assembly further comprises a section body movement arrangement adapted to move one of the section bodies towards and away from the other section body, between a disengaged position and an engaged position, wherein the subsea connection assembly further comprises a connector movement arrangement;

wherein the first section body comprises a first alignment plate and the second section body comprises an oppositely arranged second alignment plate, one of which comprises a guide pin and the other of which comprises a facing guide funnel;

wherein at least one of the guide pin and the guide funnel exhibits a tapered face; and wherein the guide funnel comprises a radially inwardly protruding collar, past which a cylindrical part of the guide pin is adapted to travel upon insertion in the guide funnel.

7. A subsea high voltage connection assembly comprising a first section having a first section body to which a set of first connector(s) is arranged and a second section having second section body to which a set of second connectors(s) is arranged, wherein the subsea connection assembly further comprises a section body movement arrangement adapted to move one of the section bodies towards and away from the other section body, between a disengaged position and an engaged position, wherein the subsea connection assembly further comprises a connector movement arrangement;

wherein the first section body comprises a first alignment plate and the second section body comprises an oppositely arranged second alignment plate, one of which comprises a guide pin and the other of which comprises a facing guide funnel; and wherein the first alignment plate comprises two first abutment faces and the second alignment plate comprises two second abutment faces, wherein the first and second abutment faces are adapted to abut against each other in a position of the alignment plates where the guide pin is fully inserted into the guide funnel.

8. A subsea high voltage connection assembly comprising a first section having a first section body to which a set of first connector(s) is arranged and a second section having second section body to which a set of second connector(s) is arranged, wherein the subsea connection assembly further comprises a section body movement arrangement adapted to move one of the section bodies towards and away from the other section body, between a disengaged position and an engaged position, wherein the subsea connection assembly further comprises a connector movement arrangement; and wherein the set of first connector(s) or the set of second connector(s) is fixed to a reaction plate which is functionally connected to said connector movement arrangement and which is movably supported in the first or second section body.

9. The subsea high voltage connection assembly according to claim 8, wherein the set of first or set of second connector(s) connects to lines extending out from the connection assembly, via a set of penetrators and a cable support assembly, wherein said lines are retained in the cable support assembly and wherein the cable support assembly is supported in the first or second section body with a sliding support arrangement.

10. The subsea high voltage connection assembly according to claim 9, wherein the reaction plate connects to the cable support assembly with a connection member that connects to the cable support assembly with a flexible connection.

11. A subsea high voltage connection assembly comprising a first section having a first section body to which a set of first connector(s) is arranged and a second section having second section body to which a set of second connector(s) is arranged, wherein, the subsea connection assembly further comprises a section body movement arrangement adapted to move one of the section bodies towards and away from the other section body, between a disengaged position and engaged position, wherein the subsea connection assembly further comprises a connector movement arrangement; and wherein the first or second section, whichever comprises the section body movement arrangement, has a section body guiding arrangement adapted to guide the first or second section body along a first movement path between the disengaged and engaged position, wherein the first movement path comprises two movement path sections, wherein the movement path section being closest to or including the disengaged position exhibits less freedom of movement in transverse directions which are transverse to the first movement path, than the movement path section being closest to or including the engaged position.

12. The subsea high voltage connection assembly according to claim 11, wherein the section body guiding arrangement comprises a guide slot in a plate which is part of the section body and a guide member which is fixed, the guide member comprising a guide portion extending through the guide slot and an end flange limiting said transverse directions, wherein a freedom limitation element is fixed to the plate having the guide slot and is positioned between the plate and end flange along the movement path section being closest to or including the disengaged position.

13. A subsea high voltage connection assembly comprising a first section having a first section body to which a set of first connector(s) is arranged and a second section having a second section body to which a set of second connector(s) is arranged, wherein the subsea connection assembly further comprises a section body movement arrangement adapted to move one of the section bodies towards and away from the other section body, between a disengaged position and an engaged position, wherein the first section body comprises a first alignment plate and the second section body comprises an oppositely arranged second alignment plate, one of which comprises a guide pin and the other of which comprises a facing guide funnel, wherein the first alignment plate comprises two first abutment faces and the second alignment plate comprises two second abutment faces, wherein the first and second abutment faces are adapted to abut against each other in a position of the alignment plates where the guide pin is fully inserted into the guide funnel.

14. The subsea high voltage connection assembly according to claim 13, wherein the guide pin and/or the guide funnel exhibits a tapered face; and wherein the guide pin comprises a head portion at its front end and a stem portion between the head portion and its base, wherein the head portion exhibits a larger diameter than the stem portion.

15. The subsea high voltage connection assembly according to claim 14, wherein the head portion at its outer diameter has a convex shape.

16. The subsea high voltage connection assembly according to claim 13, wherein:

the guide pin and/or the guide funnel exhibits a tapered face; and the guide funnel comprises a radially inwardly protruding collar, past which a cylindrical part of the guide pin is adapted to travel upon insertion in the guide funnel.

17. The subsea high voltage connection assembly according to claim 13, wherein the first or second section, whichever comprises the section body movement arrangement, has a section body guiding arrangement adapted to guide the first or second section body along a first movement path between the disengaged and engaged position, wherein the first movement path comprises two movement path sections, wherein the movement path section being closest to or including the disengaged position exhibits less freedom of movement in transverse directions which are transverse to the first movement path, than the movement path section being closest to or including the engaged position.

18. The subsea high voltage connection assembly according to claim 17, wherein the section body guiding arrangement comprises a guide slot in a plate which is part of the section body and a guide member which is fixed, the guide member comprising a guide portion extending through the guide slot and an end flange limiting said transverse directions, wherein a freedom limitation element is fixed to the plate having the guide slot and is positioned between the plate and end flange along the movement path section being closest to or including the disengaged position.

19. A method of connecting a set of first connectors with a set of second connector(s) of a subsea connection assembly, the connectors being high voltage wet-mate connectors, wherein the set of first connector(s) is in connection with a first alignment plate and the set of second connectors is in connection with a second alignment plate, one of the first and second alignment plates comprising a guide pin and the other a guide funnel adapted to engage upon a mutual movement of the alignment plates towards each other, the method comprising:

a) with a first movement, moving the alignment plates, along with the connected connectors mutually towards each other, thereby engaging the guide pin and the guide funnel, thereby arranging the alignment plates in a mutually aligned position; and b) with a second movement, moving the set of first connector(s) and the set of second connector(s) into a connected mode, while the alignment plates remain in said aligned and non-moving position;

while the alignment plates remain in said aligned and non-moving position:

c) moving said set of first connector(s) and set of second connector(s) out of the connected mode and into a disconnected mode; and d) with another second movement, moving an auxiliary set of first connector(s) and an auxiliary set of second connector(s) into a connected move.

20. The subsea high voltage wet mate connector assembly according to claim 4, wherein a movable and spring-loaded piston constitutes a partition between the third liquid chamber and the protective liquid and a biasing spring is biased to exert a biasing force on the spring-loaded piston.

21. A subsea high voltage wet mate connector assembly comprising a male connector having a male connector main body and a female connector having a female connector main body, the male and female connectors are adapted to be joined into an engaged position and separated out to a disengaged position, in which engaged position the male connector is aligned with the female connector and the male connector main body and the female connector main body remain in a constant mutual position, wherein, when in said engaged position, a contact pin of the male connector is adapted to move between a connected position, in which it is inserted into a contact bore of the female connector, and a disconnected position, in which it is retracted into the male connector;

wherein the contact pin comprises and electric conducting contact face that faces in a radial direction with respect to the axial direction of the contact pin, the contact face is in electric contact with a radially inner face of a bore conductor which constitutes part of said contact bore when the contact pin is in the connected position; and wherein the contact pin comprises a male isolation head at its front end, which male isolation head constitutes a radial isolating face along a distance between the contact face and the front of the contact pin.

22. A subsea high voltage wet mate connector assembly comprising a male connector having a male connector main body and a female connector having a female connector main body, the male and female connectors are adapted to be joined into an engaged position and separated out to a disengaged position, in which engaged position the male connector is aligned with the female connector and the male connector main body and the female connector main body remain in a constant mutual position, wherein, when in said engaged position, a contact pin of the male connector is adapted to move between a connected position, in which it is inserted into a contact bore of the female connector, and a disconnected position, in which it is retracted into the male connector; and wherein at least one of the male connector main body and the female connector main body has an axially extending portion with a cylindrical outer surface which is arranged within and with a radial distance from a cylindrical inner surface of an axially extending portion of an attachment body, wherein a flexible body is arranged between the cylindrical outer and inner surfaces.

23. The subsea high voltage wet mate connector assembly according to claim 21, wherein the female connector comprises a female isolation head arranged in the contact bore, wherein the female isolation head abuts the male isolation head both in the connected position and in the disconnected position.

24. The subsea high voltage wet mate connector assembly according to claim 21, wherein in the disconnected position, the contact face is confined and protected radially within an isolating protection sleeve and axially by said male isolation head and an isolating sleeve, the isolating sleeve being part of the contact pin; and the face of the bore conductor which is adapted to contact the contact face in the connected position, is confined and protected radially by a sleeve portion.

25. The subsea high voltage wet mate connector assembly according to claim 21, wherein when in the engaged position and the disconnected position, an axially facing male connector forward face surrounds a front face of the contact pin, while an oppositely axially facing female connector forward face surrounds a corresponding front face of a female isolation head, wherein the male connector forward face abuts the female connector forward face and wherein the front face of the contact pin abuts the front face of the female isolation head, and wherein a respective seal surrounds and seals against radially facing faces of the male isolation head and the female isolation head.

26. The subsea high voltage wet mate connector assembly according to claim 22, wherein the flexible body substantially exhibits a cylinder shape.

* * * * *